United States Patent [19]

LeDrew

[11] Patent Number: 4,493,453

[45] Date of Patent: Jan. 15, 1985

[54] BOX FOR DISPLAY AND DISPENSING ARTICLES

[75] Inventor: Robert B. LeDrew, Newport News, Va.

[73] Assignee: Williamsburg Packaging Corporation, Newport News, Va.

[21] Appl. No.: 479,813

[22] Filed: Mar. 28, 1983

[51] Int. Cl.[3] ..... B65D 5/72; A47F 3/02

[52] U.S. Cl. ..... 229/17 B; 229/38; 229/15; 229/27; 229/29 E; 206/45.11; 312/42

[58] Field of Search ..... 229/17 B, 17 R, 37 R, 229/38, 23 R, 27, 15, 29 E, 30, 42, 29 C, 29 D, 32; 206/45.11, 44 R, 561, 172, 175, 183, 184, 187; 312/258, 259, 193, 50, 42

[56] References Cited

U.S. PATENT DOCUMENTS

| | | | |
|---|---|---|---|
| 975,121 | 11/1910 | Carter | 229/38 |
| 1,112,752 | 10/1914 | Avellanal | 229/27 |
| 1,908,841 | 5/1933 | Hawks | 229/30 |
| 1,915,341 | 6/1933 | Walker et al. | 229/17 B |
| 1,972,406 | 9/1934 | Marsh | 229/17 B |
| 1,973,209 | 9/1934 | Hooker | 229/37 R |
| 1,999,361 | 4/1935 | James et al. | 229/42 |
| 2,567,017 | 9/1951 | Gillespie | 229/17 R |
| 2,743,050 | 4/1956 | Crane | 229/27 |
| 2,875,939 | 3/1959 | Crane | 229/45 |
| 2,899,122 | 8/1959 | Schaefer | 229/42 |
| 3,029,997 | 4/1962 | Kauffeld | 229/17 R |
| 3,064,873 | 11/1962 | Robinson et al. | 229/17 R |
| 3,147,904 | 9/1964 | Larson | 229/17 R |
| 3,204,762 | 9/1965 | Shanok et al. | 229/17 B |
| 3,302,847 | 2/1967 | Hennessey | 229/37 R |
| 3,365,111 | 1/1968 | McNair, Jr. et al. | 229/37 R |
| 3,804,321 | 4/1974 | Forbes, Jr. | 229/38 |
| 4,170,325 | 10/1979 | Pawlowski et al. | 229/17 B |
| 4,264,006 | 4/1981 | Swanberg | 229/39 R |
| 4,401,255 | 8/1983 | Conroy et al. | 229/37 R |
| 4,413,769 | 11/1983 | Machetti | 229/27 |

*Primary Examiner*—Allan N. Shoap
*Assistant Examiner*—Bryon Gehman
*Attorney, Agent, or Firm*—Shlesinger, Arkwright, Garvey & Fado

[57] ABSTRACT

A closure for one end of a carton having four walls has a first pair of opposed flaps extending from two of the walls. Each flap of the first pair of flaps has a generally triangular portion. A second pair of opposed flaps extend from the other two of the walls and are connected to the first pair of flaps for thereby providing an endless series of flaps. One of the flaps of the first pair has a height exceeding the height of the other of the first pair. The flaps of the second pair gradually increase in height whereby folding of the first pair of flaps followed by folding of the second pair of flaps causes the flaps to be disposed below the plane of the carton bottom for thereby being maintained in a snap locking engagement.

24 Claims, 20 Drawing Figures

FIGURE 8
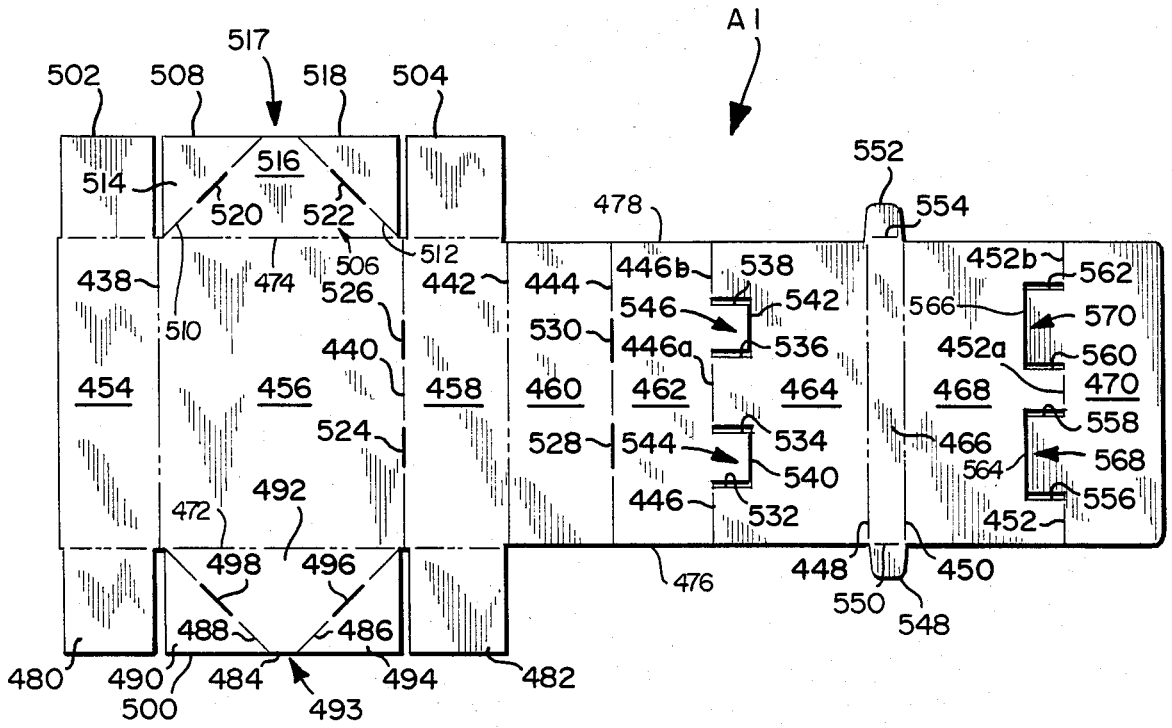
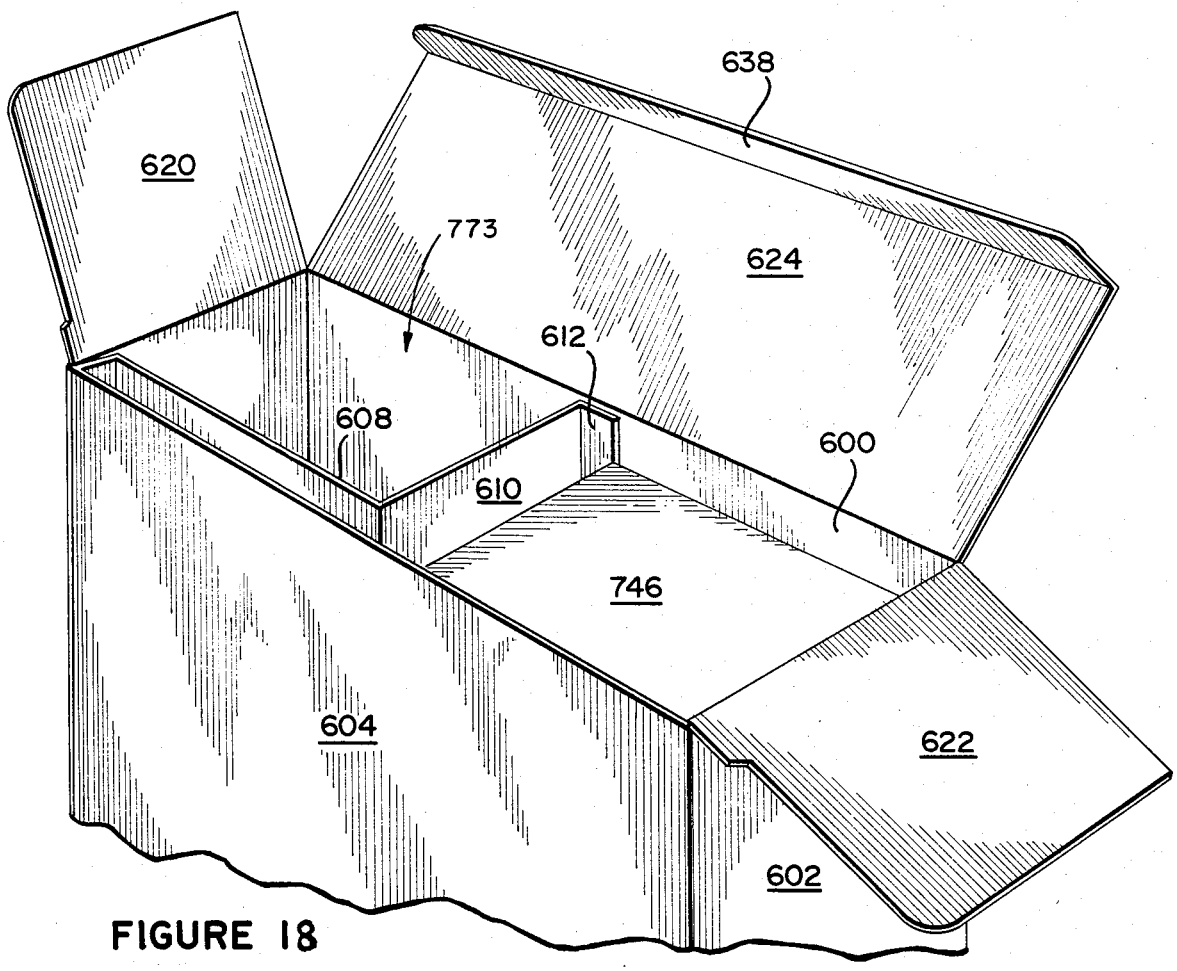
FIGURE 18

BOX FOR DISPLAY AND DISPENSING ARTICLES

BACKGROUND OF THE INVENTION

Self-service display cartons are desirable because they allow the ultimate consumer to view the product and to secure as many of the products as may be desired. The self-service feature minimizes the need for a salesperson to display and provide the required number of products. The present invention deals with a self-service display carton which employs an improved closure mechanism for securing the lower end of the carton.

It is known from Roccaforte, U.S. Pat. No. 3,147,906, to provide a self-service display carton with a platform for holding the product. It is known from Pawlowski et al. U.S. Pat. No. 4,170,325, to provide a self-service display carton adapted for being divided into two chambers, each chamber adapted for dispensing the product. Neither Roccaforte nor Pawlowski provides a display carton which has a self-locking closure mechanism for the lower end of the carton which enables the carton's lower end to be sealed without glue and which assures that the closure flaps do not bend outwardly from the carton to upset the display carton.

Consequently, an improved closure mechanism for sealing the lower end of a self-service display carton is necessary. It is advantageous that this carton have an insert adapted for holding and displaying at least two different types of products.

OBJECTS AND SUMMARY OF THE INVENTION

It is a primary object of the disclosed invention is to provide a display carton with an insert for dividing the carton into a number of chambers and which is adapted for holding and dispensing a plurality of products.

Yet another object of the disclosed invention is to provide a snap lock self-locking closure mechanism for the lower end of the carton.

It is a further object of the disclosed invention to provide a closure mechanism which requires no glue for securing the closure mechanism.

Still another object of the disclosed invention is to provide a display carton which contains an auxiliary chamber for storing an additional supply of products.

Yet still another object of the disclosed invention is to provide a display carton which is capable of being divided into two distinctly and differently sized chambers, each of which is adapted for receiving an insert for displaying and dispensing a plurality of different sized products.

Yet still another object of the disclosed invention is to provide a one piece carton blank which includes a platform for holding the product at the desired elevation.

Still yet another object of the disclosed invention is to provide an improved closure mechanism which cooperates with the platform for adding strength thereto.

Yet a further object of the disclosed invention is to provide an insert with a structural dividing member adapted for separating, displaying, and dispensing at least two distinct types of products.

These methods and other objects of the invention will be apparent from the following description and claims.

DESCRIPTION OF THE DRAWINGS

In the accompanying drawings which illustrate by way of example various embodiments of this invention:

FIG. 8 is a blank used for manufacturing another insert used with the invention;

FIG. 18 is a fragmentary perspective view of the carton blank of FIG. 9 in the assembled condition;

DESCRIPTION OF THE INVENTION

Figure 1:
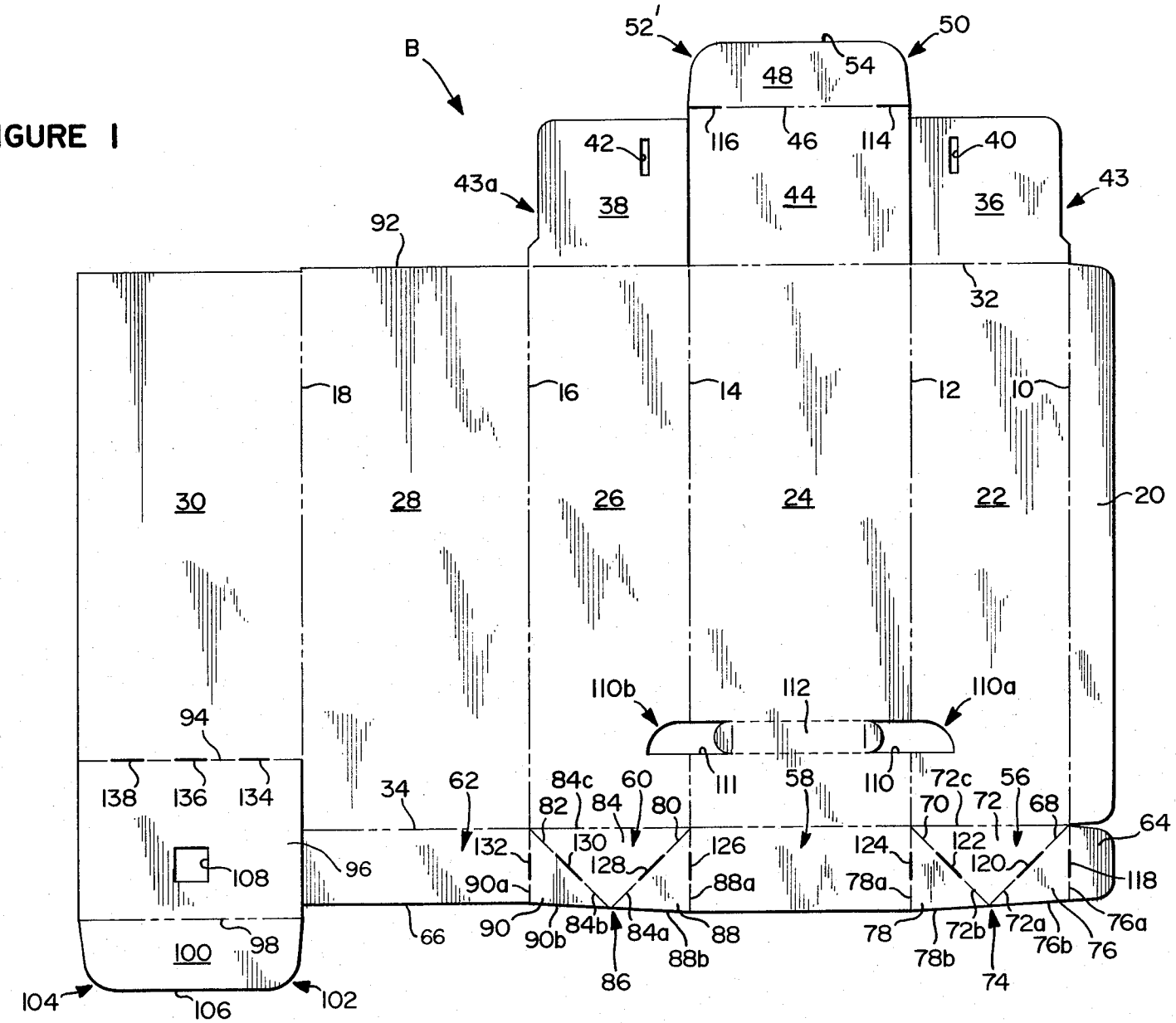
FIG. 1 is a top plan view of the blank used for manufacturing the display carton of the invention.

Referring now to FIG. 1, a carton blank B is a flat planar member constructed of paper, cardboard, or other suitable packaging material. The blank B may be pre-cut so that the blank B has an outline conforming to the requirements of the carton to be manufactured. Score lines and slits, as will be explained further, may be incorporated into the blank B so that the carton may be manufactured readily and with minimal labor.

The blank B has spaced parallel score lines 10, 12, 14, 16 and 18, respectively, arranged thereon. Score lines 10, 12, 14, 16 and 18 define a glue flap 20, a first side wall 22, a front wall 24, a second side wall 26, a rear wall 28, and a panel 30, respectively.

A transverse score line 32 defines the upper end of side wall 22, front wall 24 and side wall 26. A second transverse score line 34, spaced a pre-selected distance from score line 32, defines the lower end of side wall 22, front wall 24, side wall 26, and rear wall 28 and the base for carton C.

A first auxilary top closure flap 36 extends from the upper end of side wall 22 and is foldable about score line 32. A second auxilary top closure flap 38 extends from the upper end of side wall 26 and is foldable about score line 32. Cooperating flaps 36 and 38 extend from score line 32 a distance substantially less than the length of front wall 24 and rear wall 28 and include cooperating rectangular apertures 40 and 42, respectively, whose use shall be explained later. Flap 36 has a notch 43 and flap 38 has a notch 43*a*.

A top closure flap 44 extends from the upper end of front wall 24 and is foldable about score line 32. Top closure 44 is substantially rectangular in shape and has a transverse score line 46 toward its outwardly extending edge thereof for defining a tuck-in flap 48. Tuck-in flap 48 has tapered side edges 50 and 52 which are rounded off and lead to front edge 54.

A first bottom closure flap 56 extends from the lower end of side wall 22 and is foldable about score line 34. A second bottom closure flap 58 extends from the lower end of front wall 24 and is likewise foldable about score line 34. A third bottom closure flap 60 extends from the lower end of side wall 26 and is foldable about score line 34. A fourth bottom closure flap 62 extends from the lower end of rear wall 28 and is, likewise, foldable about score line 34. An auxiliary glue flap 64 is connected to the side edge of first bottom closure flap 56. Score lines 10, 12, 14 and 16 extend longitudinally the length of glue flap 64, first bottom closure flap 56, second bottom closure flap 58, third bottom closure flap 60, and fourth bottom closure flap 62, respectively. Closure flaps 56, 58, 60 and 62 are interconnected and form an endless series of flaps.

Blank B has a lower outer edge 66 whose distance from score line 34 increases from glue flap 64 to front wall closure flap 58. Flap 56 has cooperating score lines 68 and 70, which define a generally triangular portion 72 and which intersect at apex 74 located at outer edge 66. Cooperating score line 68 and 70 also form generally triangular portions 76 and 78 which are foldable on their score lines 68 and 70, respectively.

Triangular portion 72 is an isosceles triangle and has equal length sides 72*a*, 72*b* and 72*c*. Triangular portion 76 has sides 72*a*, 76*a*, and 76*b*. Triangular portion 78 has sides 72*b*, 78*a* and 78*b*. Sides or edges 76*a* and 78*a* are disposed in a spaced parallel relationship and side 78*a* has a length exceeding that of side 76*a*.

Outer edge 66 is maintained a fixed distance from score line 34 along the length of extension flap 58 and is maintained in a spaced parallel relationship with score line 34.

Edge 66 decreases in distance from score line 14 to score line 16. The amount by which edge 66 changes elevation over the length of extension flap 60 corresponds to the change in elevation of edge 66 along the length of extension 56.

Edge 66 is maintained in a spaced parallel relationship for the length of extension flap 62. The amount by which edge 66 extends from score line 34 along the length of flap 62 is less than the amount by which edge 66 extends from score line 34 over the length of flap 58.

Flap 60 contains cooperating score lines 80 and 82 and define a generally triangular portion 84 having an apex 86 along outer edge 66. Score lines 80 and 82, likewise, define generally triangular sections 88 and 90 which are foldable about their respective score lines 80 and 82.

Generally triangular portion 84 is an isosceles triangle and has equal length sides 84*a* and 84*b* with base 84*c* disposed therebetween. Triangular portion 88 has sides 84*a*, 88*a* and 88*b*. Triangular portion 90 has sides 84*b*, 90*a* and 90*c*. Sides 88*a* and 90*a* are disposed in a spaced parallel relationship and side 88*a* has a length substantially equal to side 78*a* and greater than side 90*a*. Side 90*a* has a length substantially equal to side 76*a*.

Rear wall 28 and panel 30 have an outer upper edge 92 which is coincident with score line 32. Panel 30 is foldable about score line 18.

Panel 30 has a transversely extending score line 94 at its lower end thereof. Platform extension 96 extends from the lower end of panel 30 and is foldable about score line 94. Platform extension 96 is substantially rectangular in shape and has a score line 98 towards its outwardly extending edge and which defines a tuck-in flap 100. Tuck-in flap 100 has tapered edges 102 and 104 which are rounded off and lead to edge 106 which is disposed in a spaced parallel relationship relative to score line 98. Platform 96 contains aperture 108 whose purpose will be explained later.

Side walls 22 and 26 and front wall 24 contain aperture 110 which is substantially transverse of front wall 24 and which is rounded off at its outer edges 110*a* and 110*b* associated with side walls 22 and 26, respectively. A removable closure 112 may be positioned to removably seal aperture 110. Closure 112 may be connected by serrations to front wall 24.

Top closure 44 may contain slits 114 and 116 to assist in the folding of tuck in flap 48 along score line 46. Bottom closure 56 may contain slits 118, 120, 122 and 124 which likewise assist in the folding of closure 56. Closure 60 may contain slits 126, 128, 130 and 132 to assist in the folding of bottom closure 60. Platform 96 may contain sits 134, 136 and 138 to assist in the folding of platform 96 on score line 94.

Figure 2:
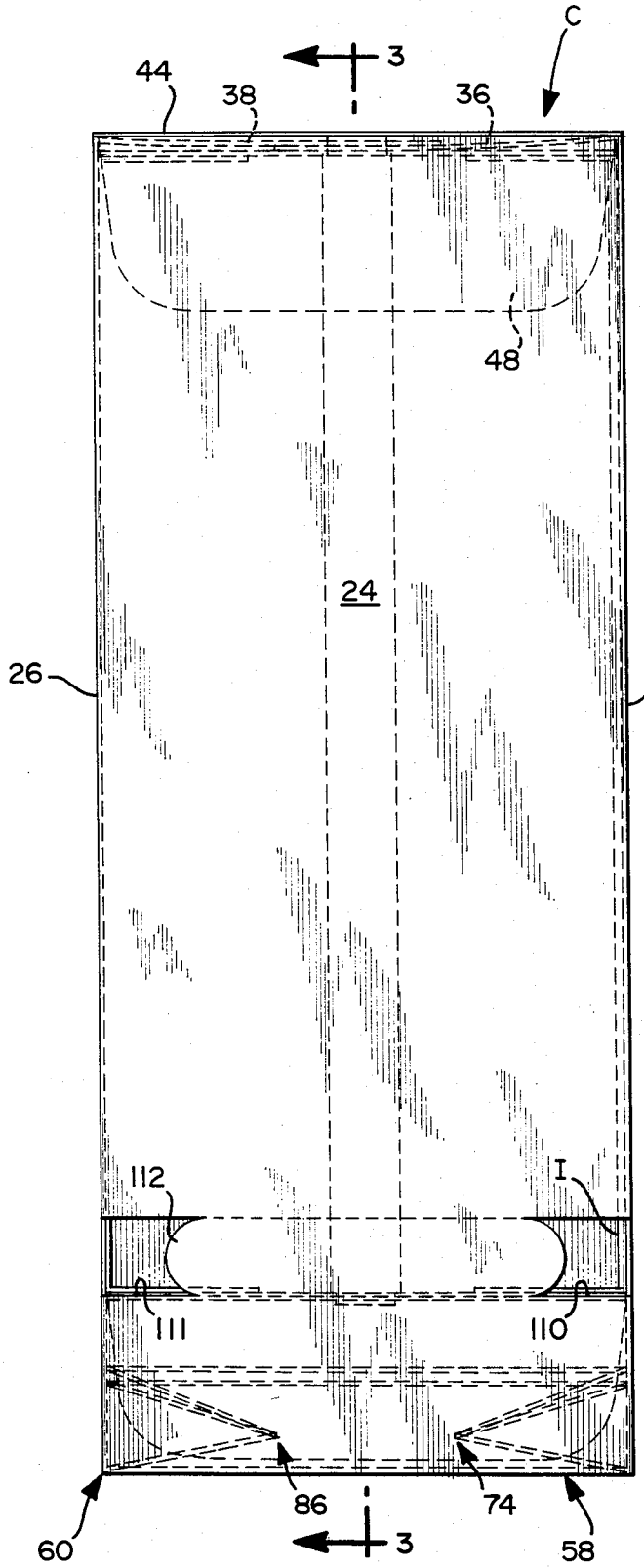
FIG. 2 is a front elevational view of the carton in the assembled condition with portions shown in phantom.
Figure 3:
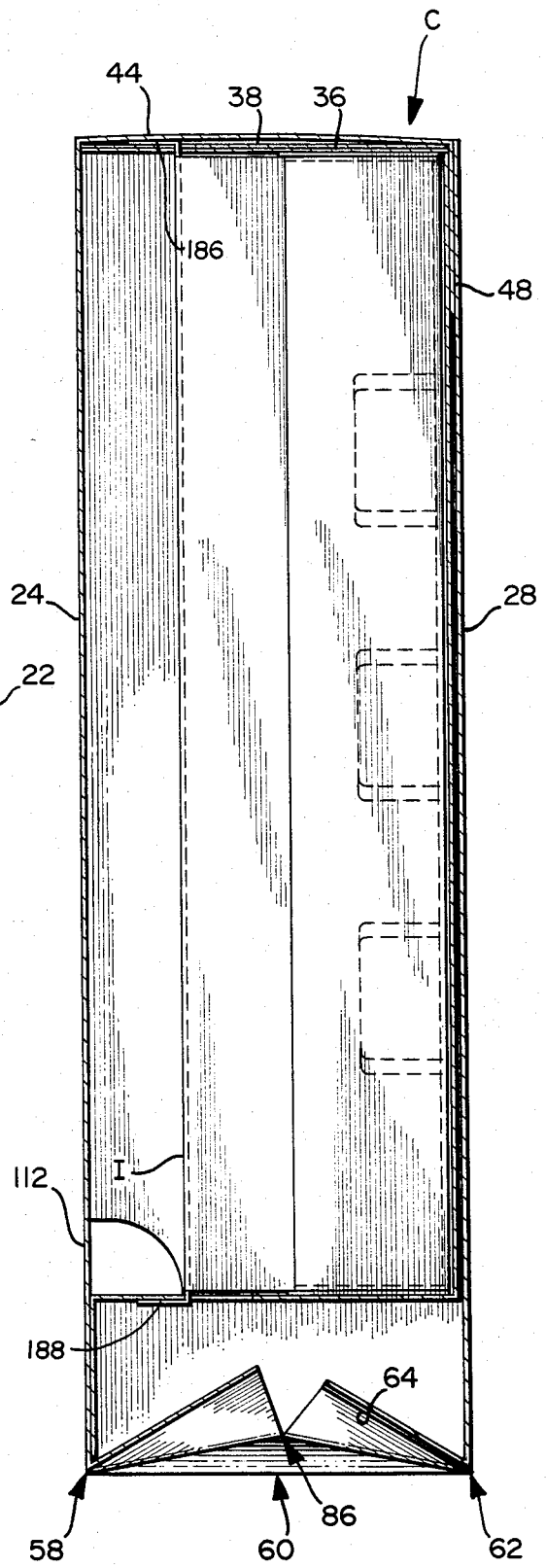
FIG. 3 is a cross-sectional view taken along the section 3—3 of FIG. 2 and viewed in the direction of the arrows with portions shown in phantom.
Figure 4:
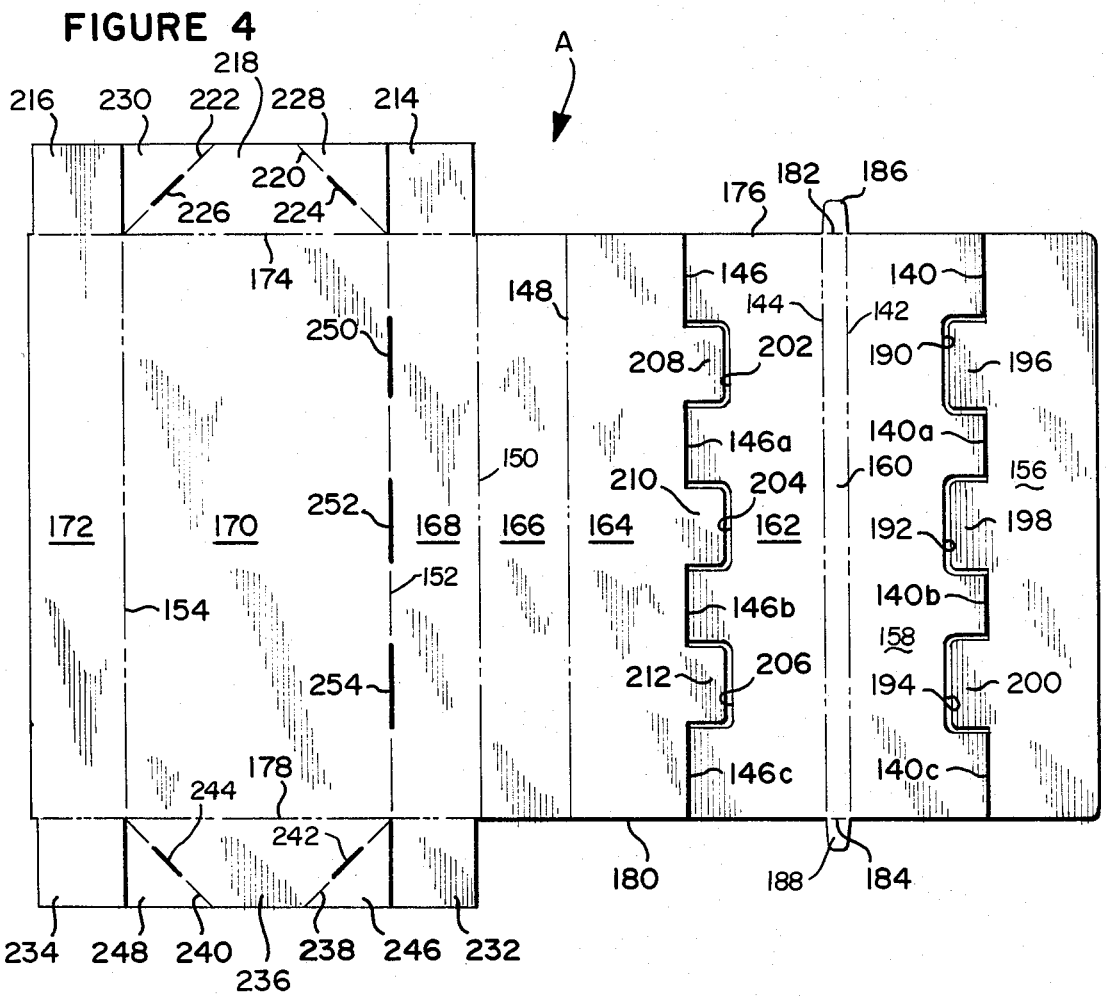
FIG. 4 is a top plan view of a blank used for manufacturing the insert used with the carton of the invention.

Carton C, as best shown in FIGS. 2 and 3, is preferably used with a removable insert I. An insert blank A is shown in FG. 4 and is used for manufacturing the insert I inserted in carton C.

Blank A is a substantially flat planar member preferably comprised of paper, cardboard, or any other suitable packaging material. Blank A is pre-cut to increase the efficiency of manufacture and the score lines, as will be explained later, may be created thereon by means known in the art.

Blank A includes score lines 140, 140*a*, 140*b*, 140*c*, 142, 144, 146, 146*a*, 146*b*, 146*c*, 148, 150, 152 and 154, respectively. Score, lines 140, 140*a*, 140*b*, 140*c*, 142, 144, 146, 146*a*, 146*b*, 146*c*, 148, 150, 152 and 154 define a second base member 156, second wall support member 158, a support connecting member 160, a first wall support member 162, a first base member 164, a third wall member 166, a second wall member 168, a flat base member 170, and a first wall member 172. Blank A has a transverse score line 174 defining an upper end for wall members 168 and 172 and flat base 170 and coincident with the outer upper edge 176 of base member 156, wall support member 158, wall support 162, base member 164 and wall member 166. Blank A, likewise, has a transverse score line 178 spaced from and parallel to transverse score line 174 and defining the lower end of wall member 168, flat base 170, and wall member 172 and coincident with the outer lower edge 180 of base member 156, wall support 158, wall support 162, base member 164 and wall member 166. Connecting member 160 has upper transverse score line 182 and lower transverse score line 184, spaced from upper transverse score line 182. Upper locking tab 186 extends from the upper end of connecting member 160 and is foldable on score line 182 which is coincident with outer edge 176. Lower tab 188 extends from the lower end of connecting member 160 and is foldable on score line 184 which is, likewise, coincident with lower outer edge 180.

Wall support 158 includes 3 generally U-shaped slits 190, 192 and 194 which define tabs or fingers 196, 198 and 200. Tabs 196, 198 and 200 are generally rectangular in shape. Wall support 162 has three similar generally U-shaped slits 202, 204 and 206. Slits 202, 204 and 206 define generally rectangular tabs or fingers 208, 210, and 212. Tabs 196, 198 and 200 have a length greater than the length of tabs 208, 210 and 212. It should be realized that the length of the tabs may be reversed from one wall member to the other. The function and uses of the tabs 196, 198, 200, 208, 210 and 212 shall be explained further later.

Upper end closure flaps 214 and 216 extend from the upper end of wall members 168 and wall member 172, respectively. Flaps 214 and 216 are foldable about score line 174. An upper closure flap 218 extends from the upper end of flat base 170 and is foldable about score line 174. Flap 218 includes score lines 220 and 222 which extend angularly toward each other from score lines 152 and 154, respectively. Score lines 220 and 222 include slits 224 and 226 which assist in folding triangular portions 228 and 230 about score lines 220 and 222, respectively.

Lower end closure flaps 232 and 234 extend from the lower end of wall members 168 and 172, respectively. Flaps 232 and 234 are foldable about score line 178. A lower closure flap 236 extends from the lower end of flat base 170 and is foldable about score line 178 and includes angularly disposed score lines 238 and 240 extending from score lines 152 and 154, respectively. Score lines 238 and 240 include slits 242 and 244, respectively. Slits 242 and 244 assist in the folding of generally triangular portions 246 and 248, respectively, about score lines 238 and 240.

Score line 152 preferably includes slits 250, 252 and 254 to assist in the folding of wall member 168.

FABRICATION

Panel 30 is folded along score line 18 until panel 30 is adjacent to and substantially parallel to the rear surface of rear wall 28. Rear wall 28 and closure flap 62, as well as panel 30, are folded along score line 16 until rear wall 28 is substantially perpendicular to side wall 26 and closure panel 62 is substantially perpendicular to closure panel 60. Side wall 26 and closure 60 are folded along score line 14 until side wall 26 is substantially perpendicular to front wall 24 and closure panel 60 is substantially perpendicular to closure panel 58. Front wall 24 and closure panel 58 are folded along score line 12 until front wall 24 is substantially perpendicular the side wall 22 and closure panel 58 is substantially perpendicular to closure panel 56. Consequently, rear wall 28 and closure 62 are substantially perpendicular to side wall 22 and closure flap 56, respectively, and score line 18 is adjacent score line 10. Glue flap 20 is folded along score 10 and is secured to the exterior of rear wall 28 and glue flap 64 is secured to the exterior of closure flap 62. In this way the carton blank has now assumed a rectalinear configuration with an open hollow interior.

Tuck-in flap 100 is folded along score line 98 until tuck-in flap 100 is substantially perpendicular to platform extension 96. Platform 96 is folded along score line 94 until platform 96 is substantially perpendicular to panel 30 and the upper surface of platform extension 96 is directly adjacent the lower edge 111 of aperture 110. Edge 106 of tuck-in flap 100 is adjacent to and aligned with score line 24.

Figure 15:
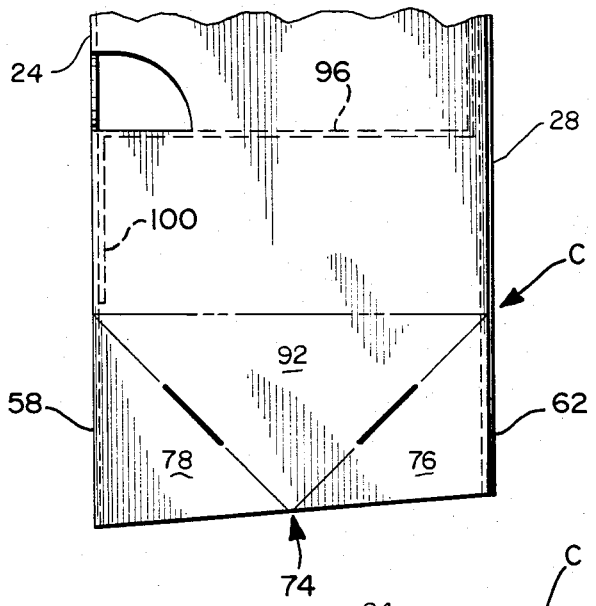
FIG. 15 is a fragmentary side elevational view of the bottom closure of the embodiment of FIG. 1.
Figure 16:
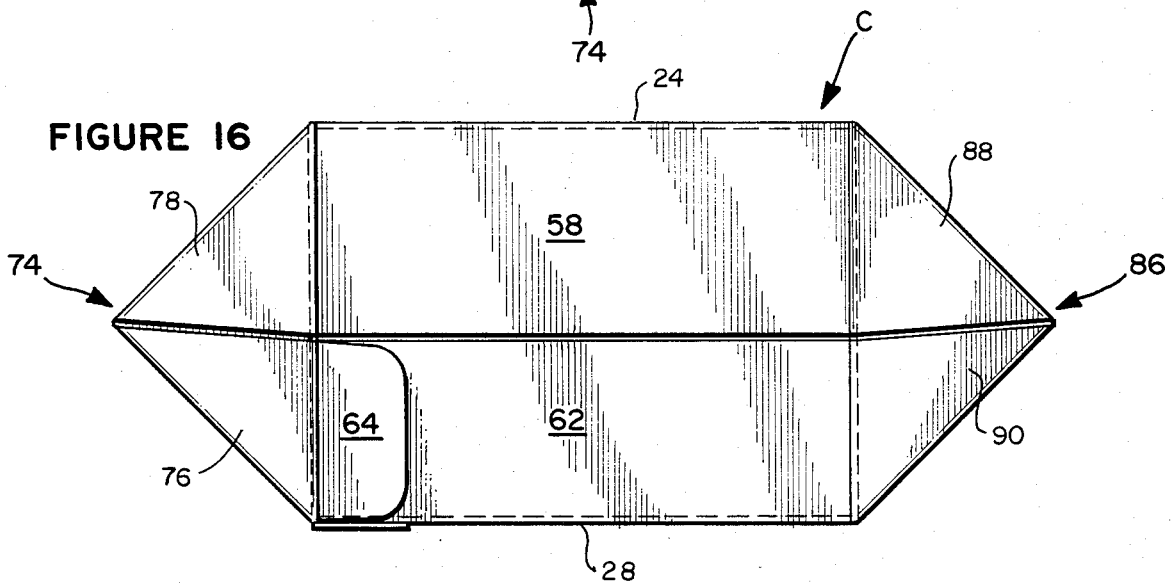
FIG. 16 is a bottom plan view of the closure of FIG. 15 disclosing the bottom closure in the partially closed position; and, FIG. 17 is a bottom plan view of the bottom closure of FIG. 15 in the closed position.
Figure 17:
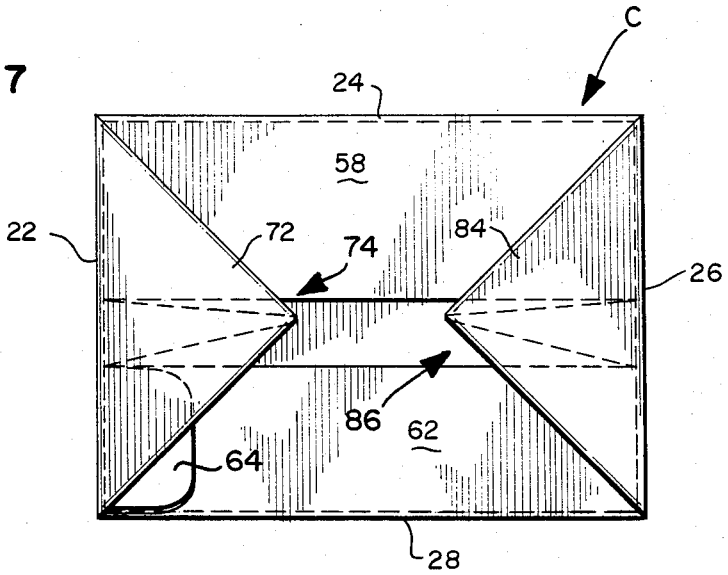

As best shown in FIGS. 15–17, the carton C has four walls 22, 24, 26 and 28 with each of the walls 22–28 having a flap extension 56, 58, 60 and 62, respectively. Each of the flap extensions 56–62 has edges on either side thereof as best shown in FIG. 1. The flap extensions 56–62 are interconnected at their edges with adjacent flap extensions to form an endless series of flaps. Said flaps form first and second cooperating pairs of opposed flaps 56, 60 and 58,62 respectively, and each flap of said pairs having a marginal edge 66. Each flap of said first cooperating pair of flaps 56,60 has a series of fold lines for substantially forming three generally triangular sections. The three triangular sections include a generally shaped central isosceles triangle bounded on one side by a first triangle and on the other side by a second triangle with the first triangle being smaller than the second triangle. The second pair of cooperating flaps 58,62 has one flap with a height greater than the height of the opposite flap and the first triangle of each of said first cooperating pair of flaps 56,60 is adjacent the opposite flap of said second cooperating pair of flaps 58,62. The first cooperating pair of flaps 56,60 has the marginal edge of each of the flaps gradually increasing in height from one of said flaps of said second cooperating pair of flaps to said opposite flap of said second cooperating pair of flaps. The three generally triangular sections of each of the first cooperating pair of flaps 56,60 are contiguous. The three generally triangular sections of each of the first cooperating pair of flaps 56,60 meet at an apex associated with the marginal edge 66 of the flaps. Folding the second cooperating pair of flaps 58,62 inwardly prior to the inward folding of the first cooperating pair of flaps 56,60 causes the end closure to snap inwardly and remain below the plane of the bottom of the carton. The gradually increasing height of the marginal edge of the first cooperating pair of flaps 56,60 permits this snap locking feature and thereby avoids the need for sealing the carton C bottom with glue, as is customary.

Referring now to FIGS. 15 through 17, the operation of the snap lock lower closure mechanism can best be seen. Closure flaps 58 and 62 are folded inwardly until they are substantially perpendicular to their walls 24 and 28, respectively. Slits 120, 122, 128 and 130 permit flaps 58 and 62 to be easily folded. Triangular portions 76, 78, 88 and 90 will now be extending upwardly at an angle from their respective wall members 22 and 26, as best shown in FIG. 16. It should be noted that closure flap 58 extends slightly beyond the midpoint of the interior of carton C. Triangular portions 72 and 84 consequently have apexs 74 and 86 which may not necessarily come to a point as shown in FIG. 1, but may be terminated and truncated. Triangular portions 72 and 84 are folded inwardly toward the interior of carton C and as they are folded inwardly they cause flaps 58 and 62 to likewise move inwardly into the interior of carton C. As triangular portions 72 and 84 are folded below the plane or bottom edge defined by score line 34, triangular portions 72 and 84 and flaps 58 and 62 snap into a locking position below the plane defined by score line 34, as best shown in FIGS. 2, 3 and 17. Tuck-in flap 100 now rests on the inside lower edge of closure 58 in the area of score line 34. Tuck-in flap 100, therefore, supports platform extension 96 and maintains platform extension 96 at the proper elevation relative to edge 111 of aperture 110. Carton C is now closed and secured at its lower end and is ready to receive insert I fabricated from blank A.

Wall member 172 is folded along score line 154 until wall member 172 is substantially perpendicular to flat base 170. Flap 218 is folded along score line 174 until upper closure flap 218 is substantially perpendicular to flat base 170. Upper closure flap 216 is folded along score line 174 and is glued to the inside surface of triangular portion 230 of closure flap 218. Similarly, lower closure flap 236 is folded along score line 178 until substantially perpendicular to flat base 170. Closure flap 234 is folded along score line 178 and glued to triangular portion 248 on its interior surface. Wall member 168 is folded along score line 152 until wall member 168 is substantially perpendicular to flat base 170. Flap 232 is folded on score line 178 and is glued to triangular portion 246 on its interior surface. Similarly, flap 214 is folded along score line 174 and is glued to the interior of triangular portion 228. Consequently, a box-shaped rectalinear structure with perpendicular side walls extending from a flat base has been created.

Figure 19:
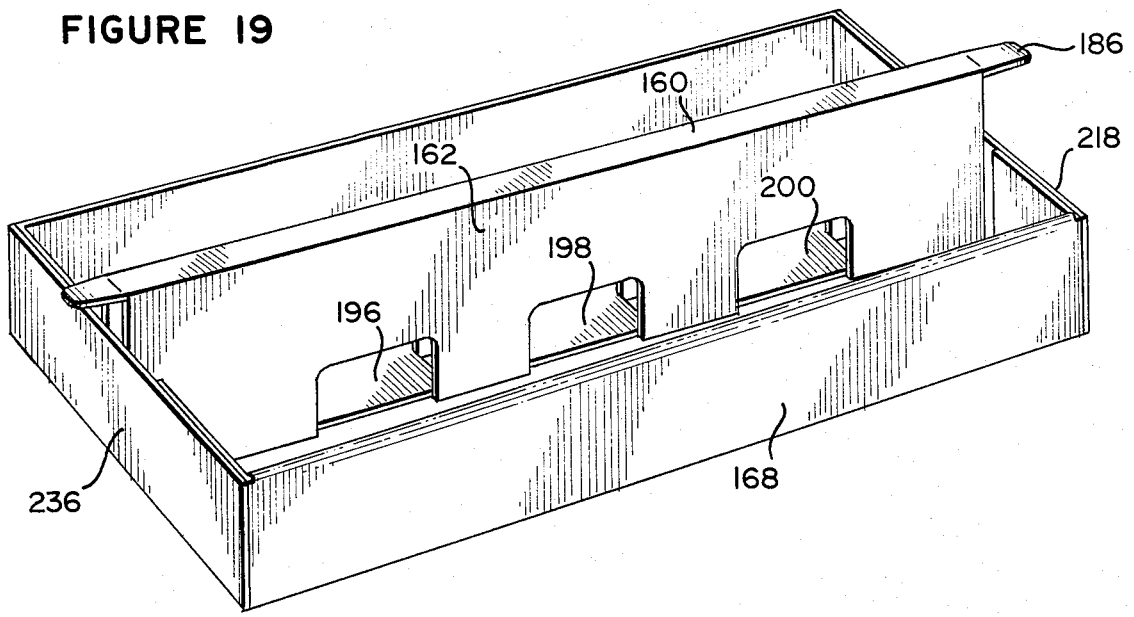
FIG. 19 is an enlarged perspective view of the insert shown in FIG. 4.

Wall member 166 is folded along score line 150 toward flat base 170 and assumes a position adjacent to and substantially parallel with wall member 168. Base member 164 is folded along score line 148 and is lowered into position so that it is adjacent to and substantially parallel with flat base 170. Wall member 162 is folded along score lines 146, **146*a*, 146*b* and 146*c* until it is substantially perpendicular to base 164 and parallel to wall member 166. During the folding of member 162, tabs 208, 210 and 212 are held firmly against flat base 170 and they extend perpendicularly to the now upstanding wall 162. Connecting member 160 is folded along score line 144 until it is substantially perpendicular to wall member 162. Wall member 158 is folded along score line 142 and base 156 is folded along score lines 140, 140*a*, 140*b* and 140*c* so that tabs 196, 198 and 200 extend outwardly from member 156. Base 156 is lowered into position so that it is adjacent to and substantially parallel with base 170 and tabs 196, 198 and 200 are placed on top of tabs 208, 210 and 212, respectively. In this way wall member 158 is substantially parallel to wall member 162 and connecting member 160 is substantially perpendicular to wall members 158 and 162 and base 156 when lowered into position. Tabs 186 and 188 extend outwardly from connecting member 160. In this way, the wall members 158 and 160 and 162 have subdivided the insert into two parallel substantially equal sized compartments or receptacles and the interdigitation of tabs 196, 198 and 200 tabs with 208, 210 and 212 maintains the wall support mechanism 158, 160 and 162 substantially parallel to walls 166 and 172 because tabs 196, 198 and 200 contact wall 162. The compartments or receptacles defined by wall 166, base 164, wall 162, connecting member 160, wall 158 and base 156 are suitable for the storage and display of rectalinear articles when the insert I, as best shown in FIG. 19**, is positioned in the carbon C, as will be explained further.

Carton C is placed on a horizontal support structure (not shown) so that rear wall 28 rests on the horizontal structure (not shown). Insert I is placed on a horizontal support structure (not shown) and its twin compartments are filled with a plurality of articles. Insert I is inserted into carton C and tab 186, or tab 188 as appropriate, enters aperture 108. Tab 186, or tab 188 as appropriate, contacts the under surface of closure 58 and tab 186, or tab 188 as appropriate, is folded along score line 176, or 180 as appropriate, and aligns itself with and is substantially parallel to closure 58. Tab 186 or tab 188 may be inserted into aperture 108 as insert I has no actual upper or lower end and any designations are merely for convenience.

The carton C is now rotated angularly so that the bottom edge, as defined by score line 34, is supported by the horizontal support structure (not shown). Flap 38 is folded along score line 32 and tab 188, or tab 186 as appropriate, passes through aperture 42. Similarly, flap 36 is folded along score line 32 and tab 188, or tab 186 as appropriate, passes through aperture 40. Flaps 38 and 36 are folded until they are perpendicular to side walls 22 and 26, respectively. Top closure 44 is folded along score line 32 and tuck-in flap 48 is folded along score line 46 and tuck-in flap 48 is positioned between rear wall 28 and the under surface of flat base 170 and front edge 54 passes through the channel defined by notches 43 and **43*a*. Top closure 44 is lowered into position until it is substantially perpendicular to front wall 24 and in this way bends tab 188, or tab 186** as appropriate, and therefore, locks the insert I into position.

To use the display carton C removable closure 112 is torn along its serrations so that the articles (not shown) held by insert I are exposed. To remove one of the articles (not shown) the customer merely takes hold of the article (not shown) desired and removes it from the insert I and the carton C through aperture 110.

CARTON AND INSERT WITH AUXILIARY CHAMBER

Figure 5:
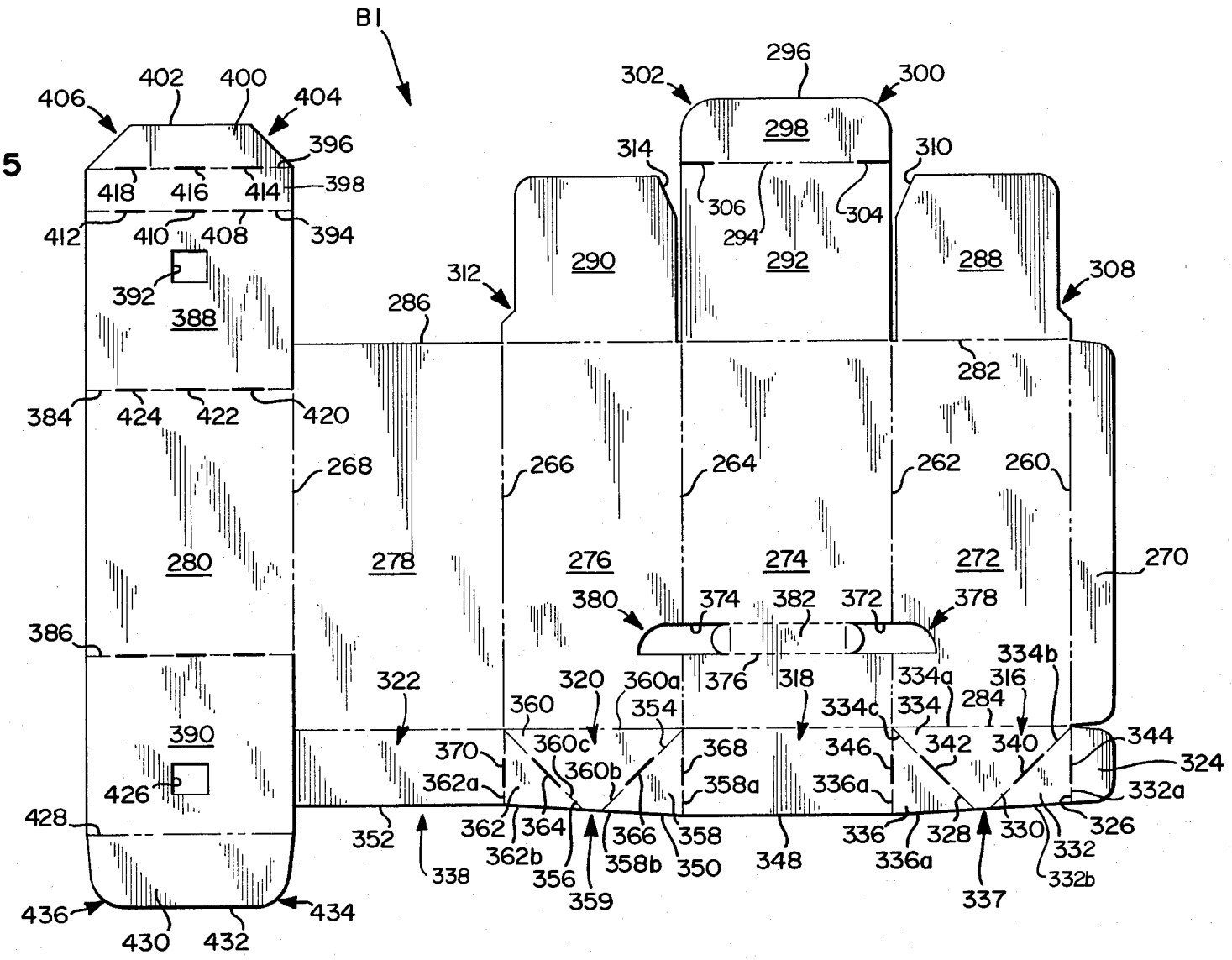
FIG. 5 is a top plan view of a carton blank used with a different embodiment of the invention.

The carton blank B1, as best shown in FIG. 5, is substantially similar to carton blank B shown in FIG. 1 with the addition of an auxiliary chamber or storage space created above insert I1. This auxiliary chamber may be utilized to store additional supplies of product or to provide a depository for a saleman's bonus.

As best shown in FIG. 5, blank B1 is a flat planar member. Blank B1 may be comprised of paper, cardboard, or any other suitable packaging carton material. Blank B1 includes score lines 260, 262, 264, 266 and 268 defining a glue flap 270, a first side wall 272, a front wall 274, a second side wall 276, a rear wall 278 and, a panel member 280. Walls 272, 274 and 276 have an upper transverse score line 282 defining an upper end thereof and a second transverse score line 284 spaced from and parallel to score line 282 defining the lower end thereof. Panel 278 has an upper edge 286 coincident with score line 282. A first auxiliary top closure flap 288 extends from the upper end of side wall 272 and is foldable about score line 282. A second auxiliary top closure flap 290 extends from the upper end of side wall 276 and is likewise foldable about score line 282. Top closure flap 292 extends from the upper end of front wall 274 and is similary foldable about score line 282. Top closure 292 has a transverse score line 294 intermediate its outer edge 296. Outer edge 296 and score line 294 define a tuck-in flap 298 which has rounded corners 300 and 302. Score line 294, preferably, includes slits 304 and 306 at its outer side edges to assist in folding tuck-in flap 298 along score line 294. Flap 288 contains longitudinally extending notch 308 which extends substantially the depth of flap 288. Flap 288 has a second notch 310 opposite notch 308. Similarly, flap 290 has longitudinally extending notch 312 and a notch 314.

A bottom closure flap 316 extends from the lower end of side walls 72 and is foldable about score line 284. A second bottom closure flap 318 extends from the lower end of front wall 274 and is similarly foldable about score line 284 and is connected to flap 316. A third bottom closure flap 320 extends from the lower end of side wall 276 and is foldable about score line 284 and is connected to flap 318. A fourth bottom closure flap 322 extends from the lower end of wall 278 and is foldable about score line 284 and is connected to flap 320. In this way, an endless series of interconnected flaps has been created. An auxiliary glue flap 324 is connected to flap 316 and is foldable about score line 326 which is coincident with score line 260.

A pair of angularly disposed cooperating score lines 328 and 330 extend from score line 284 at its intersection with score lines 262 and 260, respectively, and score lines 328 and 330 extend outwardly toward the outer edge 338 of flap 316. Score lines 328 and 330 define generally triangular portions 332, 334 and 336 of which the apex 337 of triangular portion 334 has been partially terminated by the lower outer edge 338 of flap 316. Outer edge 338 has increasing height from score line 326 to score line 262. Score lines 328 and 330 preferably includes slits 340 and 342 to assist in the folding of lower closure 316. Flap 316 further includes slits 344 and 346 arranged in score lines 260 and 262, respectively. Generally triangular portion 334 is an isosceles triangle with a base **334*a* and equal length edges 334*b* and 334 extending therefrom. Triangular portion 332 includes edges 334*b*, 332*a* and 332*b*. Triangular portion 336 has edges 334*c*,336*a* and 336*b*. Side or edge 332*a* is disposed in a spaced parallel relationship with side 336*a* and side 336*a* has a length exceeding that of side 332*a*. Edge 338 increase in distance from score line 284 from side 332*a* to side 336*a***.

Flap 318 has outer edge 348 which is parallel to score line 284 and coincident with edge 338. Flap 320 as an outer edge 350 coincident with edge 348 and which decreases in height from the outer edge 348 of flap 318 to the outer edge 352 of flap 322. Edge 352 is parallel to score line 284 and extends outwardly from score line 284 a distance less than does outer edge 348.

Bottom closure 320 includes angularly disposed score lines 354 and 356 which define generally triangular portions 358, 360 and 362. Score lines 356 and 354 are similar to score lines 342 and 340 and the outer apex of generally triangular portion 360 has been terminated by outer edge 350. Score lines 354 and 356 preferably include slits 364 and 366 to assist in the folding of bottom closure 320. Score lines 264 and 266 preferably includes slits 368 and 370. Generally triangular portion 360 is an isosceles triangle with a base **360*a* and sides 360*b* and 360*c* extending therefrom. Triangular portion 358 and sides 360*b*, 358*a* and 358*b*. Triangular portion 362 has sides 360*c*, 362*a* and 362*b*. Sides 358*a* and 362*a* are disposed in a spaced parallel relationship and are parallel to sides 332*a* and 336*a*. Side 358*a* has a length exceeding that of side 362*a***.

Side wall 276, front wall 274, and side wall 272 include transversely extending aperture 372 having upper and lower edges 374 and 376, respectively. The outer transverse edges of aperture 372 are rounded off at 378 and 380 to permit ease of removal of product. Preferably aperture 372 is closed by removable closure 382 which has serrations along upper edge 374 and lower edge 376 to assist in removal of closure 382.

Panel member 280 includes spaced parallel transverse score lines 384 and 386. An upper depository platform extension 388 extends from the upper end of panel 280 and is foldable about score line 384. A lower platform extension 390 extends from the lower end of panel 280 and is foldable about score line 386. Depository platform 288 includes aperture 392 and spaced parallel transverse score lines 394 and 396 for defining a wall member 398. Flap 400 extends outwardly from wall member 398 and is foldable on score line 396. Flap 400 includes outer edge 402 and angled edges 404 and 406 extending on either side thereof. Score lines 394 and 396, preferably, include slits 408, 410, 412, 414, 416 and 418 to assist in the folding of wall member 398 and flap 400. Score line 384, preferably, includes slits 420, 422 and 424 to assist in the folding of upper depository platform 388 along score line 384.

Platform extension 390 includes aperture 426. Transverse score line 428 is spaced from and parallel to score line 386. Support flap 430 extends from the outer end of platform 390 and is foldable about score line 428. Support platform 430 has outer edge 432 with rounded off corners 434 and 436 extending on either side thereof.

Figure 6:
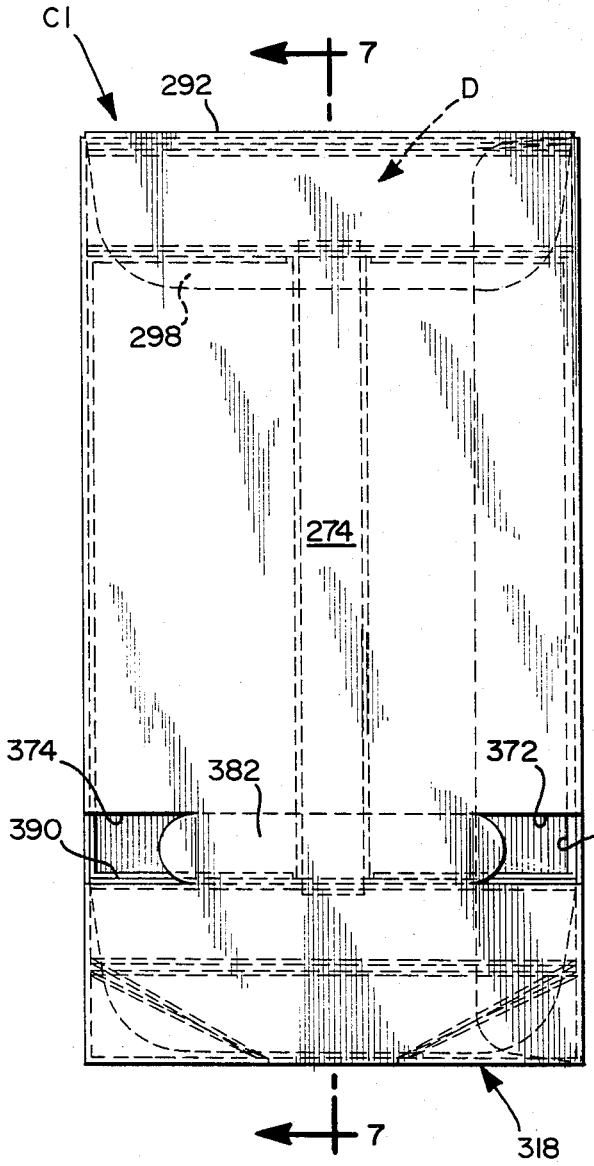
FIG. 6 is a front elevational view of the carton blank of FIG. 5 in the assembled condition and with portions shown in phantom.
Figure 7:
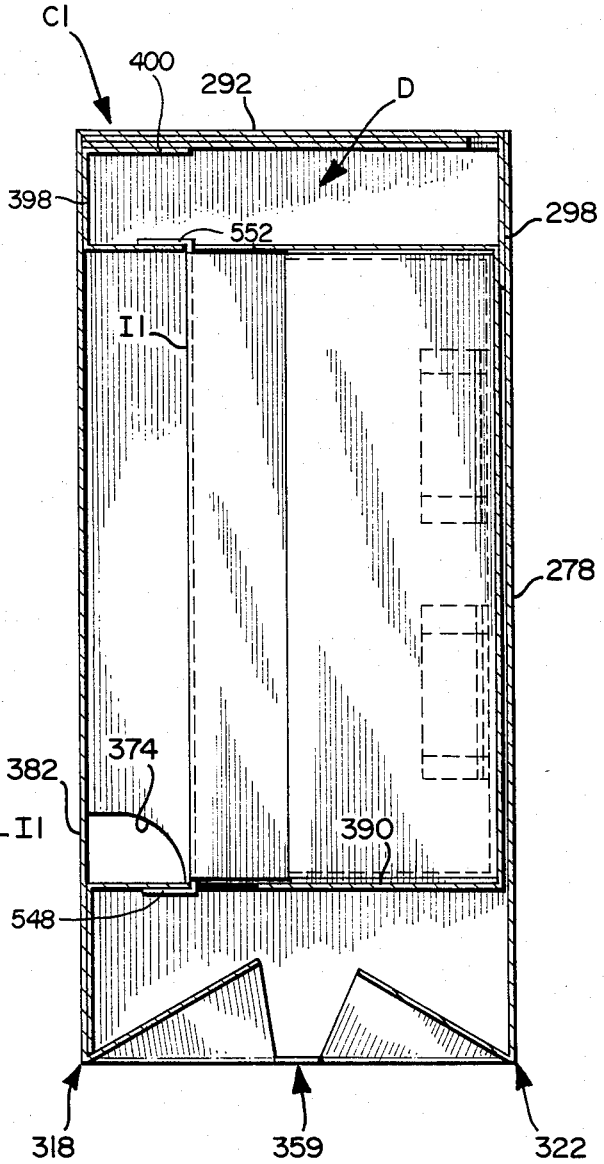
FIG. 7 is a cross-sectional view taken along the section 7—7 of FIG. 6 and viewed in the direction of the arrows and with portions shown in phantom.

Because of the upper depository platform 388, insert I, formed from blank A cannot be used with carton C1, as best shown in FIGS. 6 and 7. Blank A1, as best shown in FIG. 8, is used to manufacture insert I1 for use with carton C1.

Blank A1 is a flat planar member. Blank A1 may be manufactured from paper, cardboard, or any other suitable packaging material. Blank A1 has a longitudinal score lines 438, 440, 442, 444, 446, **446*a*, 446*b*, 448, 450, 452, 452*a* and 452*b* defining a side wall 454, a flat base 456, second and third side walls 458 and 460, a base 462, a first wall support 464, a connecting member 466, a second wall support 468, and a second base 470**.

Blank A1 has spaced parallel upper and lower transverse score lines 472 and 474, respectively. Wall 460, base 462, wall 464, wall 468 and base 470 have upper edge 476 coincident with score line 472 and lower edge 478 coincident with score line 474.

A first upper closure flap 480 extends from the upper end of wall 454 and is foldable about scoreline 472. A second upper closure flap 482 extends from the upper end of wall 458 and is foldable about score line 472. Upper closure flap 484 extends from the upper end of flat base 456 and is foldable along score line 472 and includes angularly disposed score lines 486 and 488 which define generally triangular portions 490, 492 and 494. Score lines 486 and 488 preferably contain a series of serrations 496 and 498. Generally triangular portion 492 has a portion of its apex 493 truncated due to outer edge 500.

A first lower closure flap 502 extends from the lower end of wall 454 and is foldable along score line 474. A second lower closure flap extension 504 extends from the lower end of wall 458 and is similarly foldable about score line 474. Lower closure flap 506 extends from the lower end of flat base 456 and has an outer edge 508. Closure 506 includes angularly disposed score lines 510 and 512 which define generally triangular portions 514, 516 and 518. Preferably, angularly disposed score lines 510 and 512 include a series of serrations 520 and 522 to assist in folding of triangular portions 514 and 518. The apex 517 of triangle 516 is, preferably, terminated or truncated by outer edge 508.

Preferably, score line 440 includes slits 524 and 526. Similarly, score line 444 includes slits 528 and 530.

Wall 464 includes spaced parallel rectangular apertures 532, 534 536 and 538. Apertures 532 and 534 are connected by transverse slit 540 while apertures 536 and 538 are connected by transverse slit 542. Apertures 532, 534 and slit 540 define a generally rectangular tab 544 and apertures 536, 538 and slit 542 define generally rectangular tab 546. Although two pairs of cooperating tabs are disclosed, it should be apparent that any number of cooperating tabs or fingers may be used.

Connecting member 466 includes a tab 548 extending from the upper end of connecting member 466 and foldable about score line 550. Similarly, tab 552 extends from the lower end of connecting member 466 and is foldable about score line 554.

Wall 468 includes spaced parallel generally rectangular apertures 556, 558, 560 and 562. Apertures 556 and 558 are connected by transverse slit 564 and apertures 560 and 562 are connected by a transverse slit 566. Apertures 556, 558 and slit 564 define generally rectangular tab 568 and apertures 560, 562 and slit 566 defines generally rectangular tab 570. It should be noted that slits 564 and 566 have a length exceeding the length of slits 540 and 542 for reasons which will explained later. If should be also evident, that the longer pair of slits, 564 and 566, may be located on either wall member 464 or 468 providing that a shorter pair of slits, 540 and 542, are on the opposite wall member.

FABRICATION AND USE OF BLANK B1 AND BLANK A1

Panel 280 is folded along score line 268 until it is adjacent to an substantially parallel with the inner surface of rear wall 278. Rear wall 278 is folded along score line 266 until substantially perpendicular to side wall 276. Side wall 276 is folded along the score line 264 until side wall 276 is substantially perpendicular to front wall 274. Side wall 272 is folded along score line 262 until substantially perpendicular to front wall 274. Glue flap 270 is folded along score line 260 until substantially perpendicular to side wall 272 and is secured by glue or other fastening mechanisms to the outer surface of rear wall 278. Similarly, auxiliary glue flap 324 is folded on score line 326 until substantially perpendicular to side wall bottom extension 316 and is secured to the outer surface, by glue or other fastening means, to flap 322. Blank B1 has now assumed a substantially rectalinear configuration which is hollow and open at both ends.

Support 430 is folded along score line 428 until substantially perpendicular to platform extension 390. Platform extension 390 is folded along score line 386 and inwardly into the interior of carton C1 until platform extension 390 is substantially perpendicular to panel 280 and edge 432 is adjacent to and aligned with score line 284 which forms the base or bottom of carton C1.

Front closure 318 and rear closure 322 are folded downwardly toward the interior of carton C1 until flaps 318 and 322 are substantially perpendicular to front wall 274 and rear wall 278, respectively. Generally triangular portions 334 and 360 extend angularly away from walls 272 and 278, respectively. Generally triangular portions 334 and 360 are then folded toward each other and inwardly into the interior of carton C1 which causes flaps 318 and 322 to be moved further into the interior carton C1 and as triangular portions 344 and 366 move below the plane defined by score line 284, triangular portions 334 and 360 snap downwardly into and below the plane defined by score line 284 and are locked into position. The locking mechanism is facilitated because of the unequal lengths of flaps 318 and 322 which causes flap 318 to extend beyond the midpoint of carton C1. Edge 432 may be pressed firmly against score line 284 to provide positive support for platform extension 390. Carton C1 is now ready to receive insert I1.

Wall 454 is folded along score line 438 until wall 454 is substantially perpendicular to flat base 456. Upper flap 480 is folded along score line 472 until substantially perpendicular to wall 454. Closure flap 484 is folded along score line 472 until substantially perpendicular to flat base 456 and adjacent and parallel to flap 480. Flap 480 is secured by glue, or other fastening means, to the inner surface of flap 484, preferably at triangular portion 490. Lower flap 502 is folded along score line 474 until substantially perpendicular to wall 454. Lower closure 506 is folded along score line 474 until substantially perpendicular to flat base 456 and substantially parallel to flap 502. Flap 502 is secured to the inner surface of flap 506, preferably at generally triangular portion 514.

Wall 458 is folded along score line 440 until substantially perpendicular to flat base 456. Upper flap 482 is folded along score line 472 until substantially perpendicular to wall 458 and is secured, by glue or other means, to the inner surface of flap 484, preferably at generally triangular portion 494. Flap 504 is folded along score line 474 until substantially perpendicular to wall 454 and is secured, by glue other means, to the inner surface of flap 506, preferably at generally triangular portion 518. Consequently, a rectalinear insert having a flat base and perpendicular circumferential walls has been created.

Wall 460 is folded along score line 442 inwardly and is positioned adjacent to and substantially parallel with upstanding wall 458. Base 462 is folded along score line 444 and is positioned adjacent to and substantially parallel to flat base 456. Folding of base 462 causes tabs 544 and 546 to be positioned adjacent to and parallel to flat base 456 and to be extending outwardly from base 462. Wall 464 is folded along score lines **446, 446*a* and 446*b* until substantially perpendicular to base 462. Connecting member 466 is folded along score line 448 and wall 468 is folded along score line 450. Base 470 is folded along score lines 452, 452*a* and 452*b*, which causes tabs 568 and 570 to extend outwardly from base 470 and base 470 is positioned into contact with flat base 456. Tabs 568 and 570 are positioned on top of tabs 544 and 546 as base 470 is positioned on flat base 456. The interdigitation of tabs 568 and 570 with tabs 544 and 546 causes walls 468 and 464 to assume a spaced parallel relationship and to maintain that relationship as tabs 568 and 570 contact opposed wall 464 in the area of apertures 532, 534 and 536 and 538**.

In this way, the insert I1 has parallel upstanding walls 454, 458 and 460 disposed on either side of an upstanding wall support member comprised of parallel spaced walls 468 and 464 connected by connecting member 466. Walls 454 and 464 and walls 460 and 464 define two parallel spaced compartments or receptacles which are uniquely adapted for maintaining their configuration and for holding rectalinear articles or products. Tabs 548 and 552 extend outwardly from connecting member 466 although the use of tabs 548 and 552 is not essential. Additionally, tabs 548 and 552 are designated as being associated with an upper end or lower end of insert I1 for convience only.

After insert I1 has been filled with the necessary plurality of rectalinear articles or product, it is ready for positioning in carton C1. Rear wall 278 is positioned on a horizontal support surface (not shown) an insert I1 is inserted into the upper open end thereof. Insert I1 is displaced into the interior of carton C1 until tab 548, or 552 as is appropriate, enters aperture 426. Tab 548, or 552 as appropriate, contacts flap 318 and is folded along score line 550, or 552 as appropriate, and assumes a position substantially parallel to and adjacent with flap 318. Carton C1 is rotated angularly upwardly so that the base defined by score line 284 rests on the horizontal supporting surface (not shown). Tab 552, or 548 as may be appropriate, extends upwardly. Upper depository platform 388 is folded along score line 384 until substantially perpendicular to panel 280 and until tab 552, or 548 as may appropriate, passes through aperture 392. Wall member 398 is folded along score line 394 until substantially perpendicular to upper depository platform 388 and substantially parallel to front wall 274. An additional supply of product (not shown) may be placed in upper depository area D, as best shown in FIG. 7. After the extra product (not shown) has been deposited into depository D, flap 400 is folded along score line 396 until flap 400 is substantially perpendicular to wall member 398. Carton C1 is now ready for closing. Flaps 290 and 288 are folded along score line 282 until substantially perpendicular to their respective wall members, 272 and 276. Top closure 292 is folded along score line 282 and tuck-in flap 298 is folded along score line 294. Edge 296 is inserted into the opening defined by notches 308 and 312 and is inserted downwardly into carton C1 until substantially perpendicular to front wall 274. When top closure 292 is substantially perpendicular to front wall 274, the carton is securely closed.

Notches 310 and 314 facilitate the lifting of flaps 288 and 290 when the sales person, or other person, opens carton C1 to obtain access to depository D to remove the product (not shown).

To use the carton C1, closure 382 is removed from aperture 372 by means of serrations and the individual has ready access to the products (not shown) contained in either of the two compartments associated with insert I1. The rounded corners 380 and 378 facilitate the entry of a persons fingers when grasping the product (not shown).

DOUBLE DISPLAY CARTON

Figure 9:
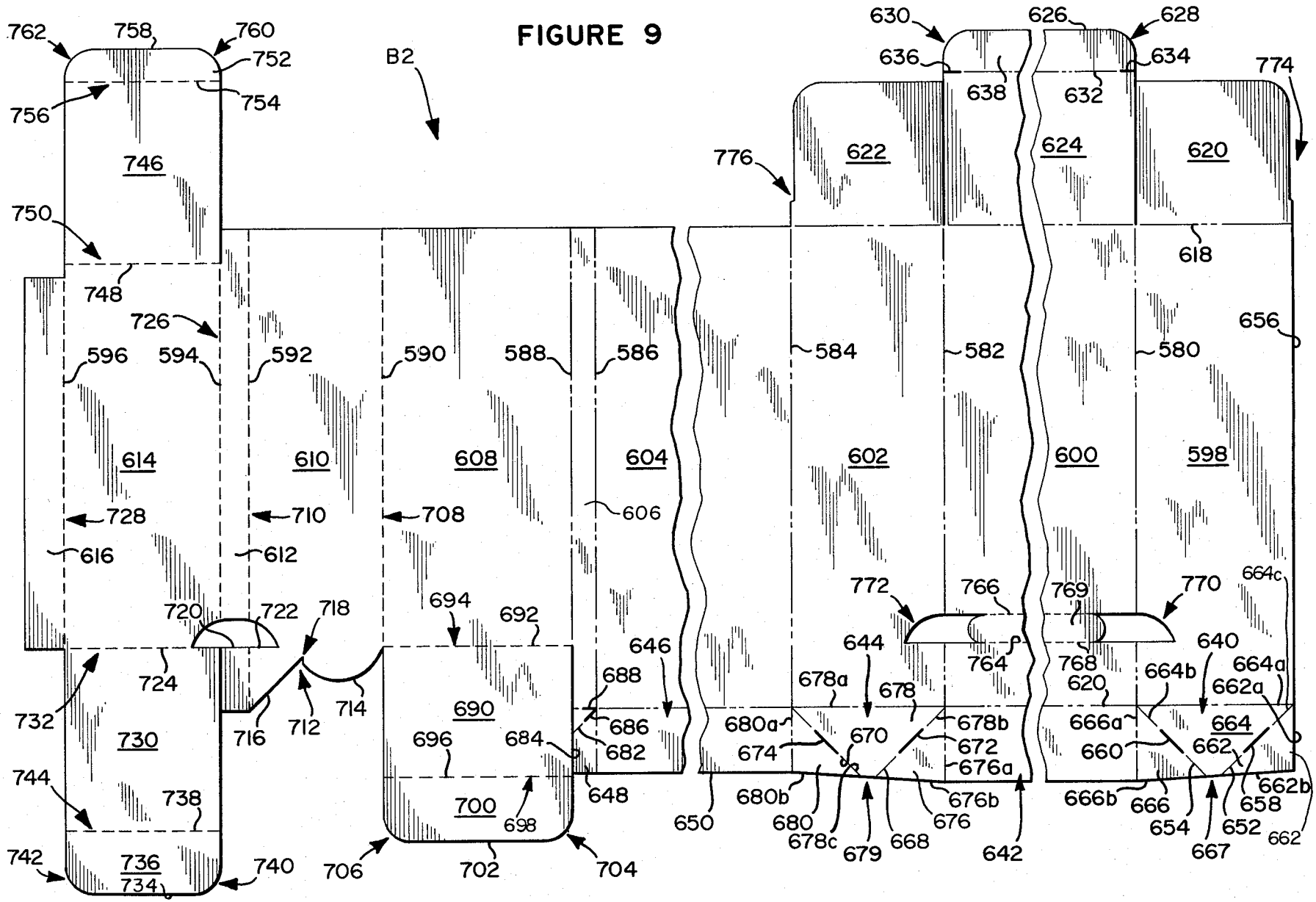
FIG. 9 is a fragmentary top plan view of a carton blank used for manufacturing a carton of another embodiment of the invention.
Figure 10:
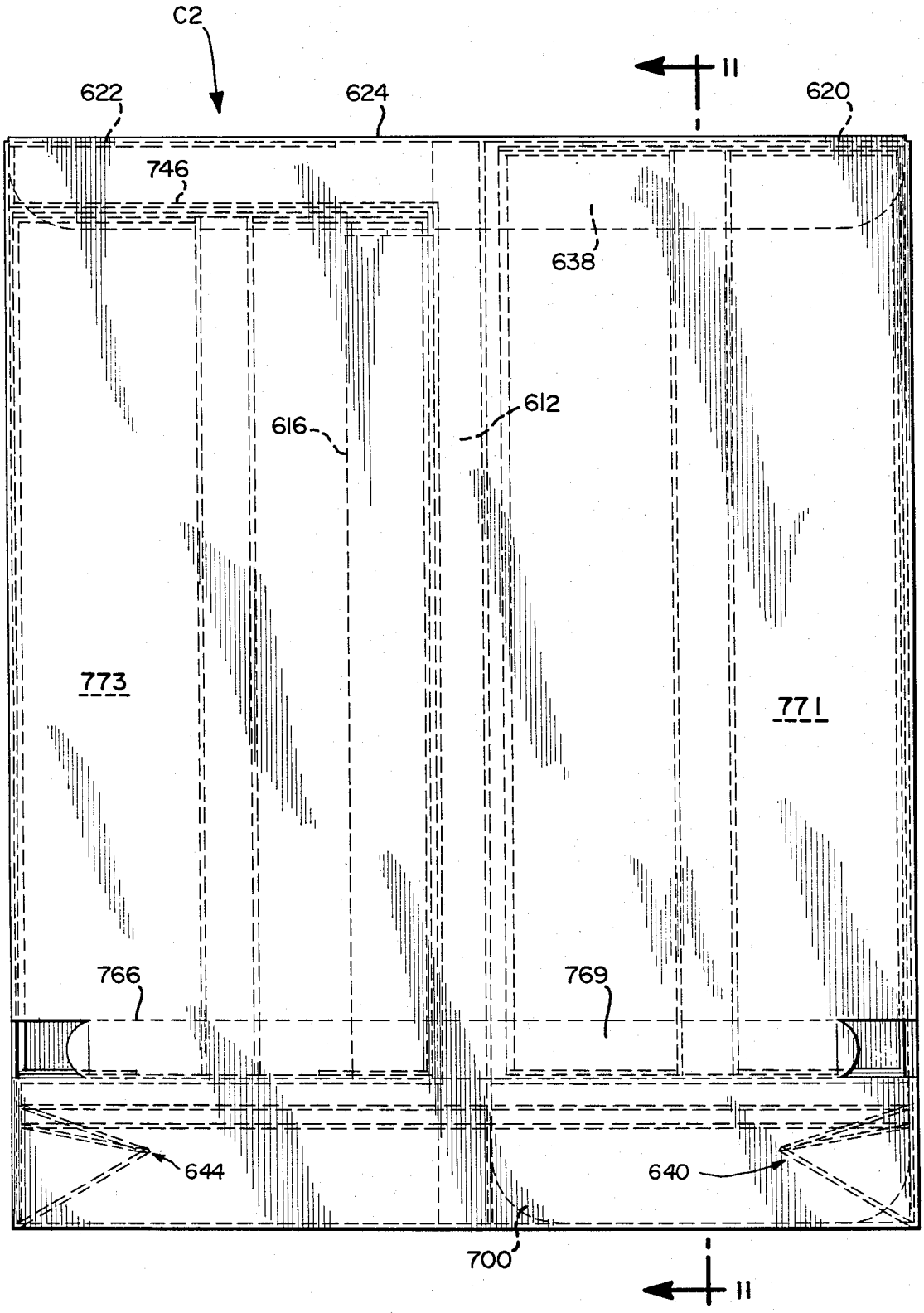
FIG. 10 is a front view of a carton blank of FIG. 9 in the assembled condition with portions shown in phantom.
Figure 11:
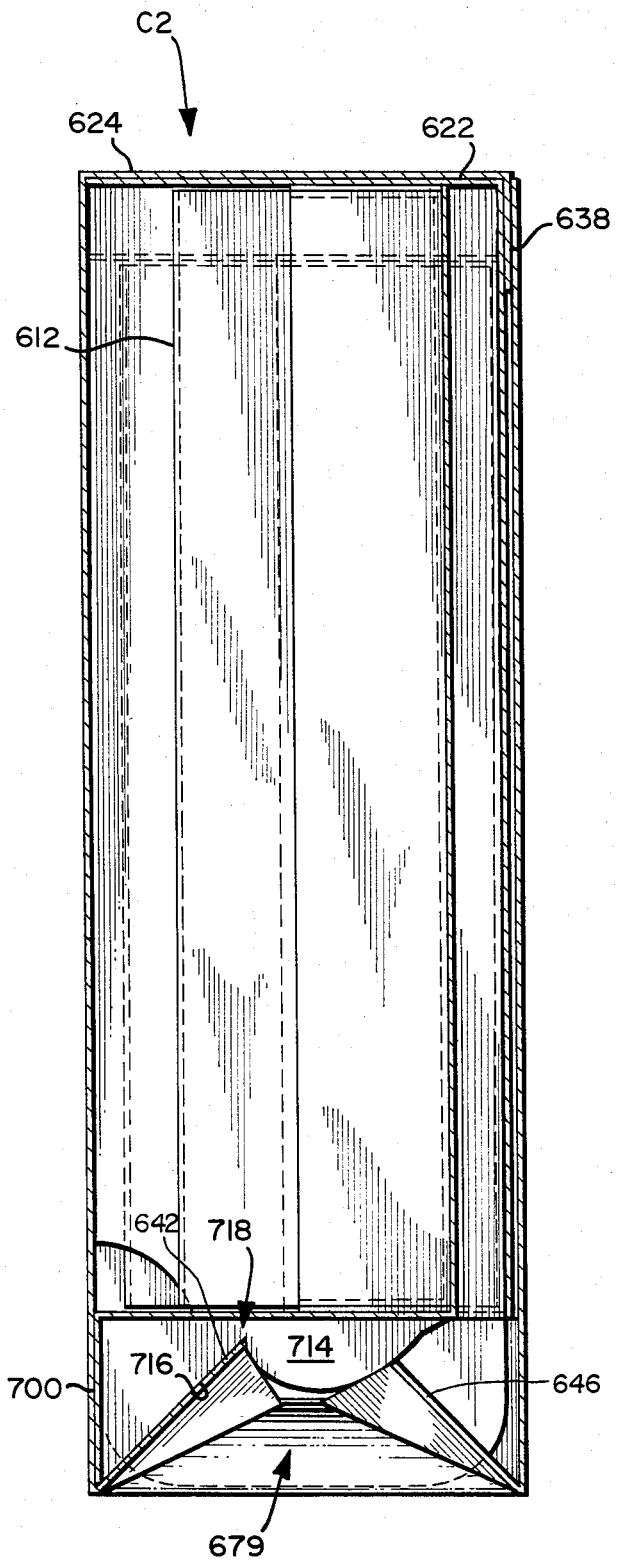
FIG. 11 is a cross-sectional view taken along the section 11—11 of FIG. 10 and viewed in the direction of the arrows and with portions shown in phantom.

Carton blank B2, best shown in FIG. 9, is used to fabricate a double display carton C2, best shown in FIGS. 10 and 11. Blank B2 is a flat planar member produced from paper, cardboard, or other suitable packaging material.

Blank B2 has spaced parallel longitudinal score lines 580, 582 584, 586, 588, 590, 592, 594 and 596 defining a first side wall 598, a front wall 600, a second side wall 602, a rear wall 604, a connecting wall 606, a panel 608, a dividing wall 610, a spacer 612, a second panel 614 and a glue flap 616. Walls 598, 600 and 602 have a first upper transverse score line 618 defining the upper end thereof and a second lower transverse score line 620 parallel to transverse score line 618 and spaced therefrom defining the lower end thereof and further defining the lower end of rear wall 604 and connecting wall 606. A first auxiliary top closure flap 620 extends from the upper end of side wall 598 and is foldable about score line 618 and a second auxiliary top closure flap 622 extends from the upper end of side wall 602 and is likewise foldable about score line 618. Main top closure flap 624 extends from the upper end of front wall 600 and is foldable about score line 618.

Closure flap 624 has an outwardly extending edge 626 with curved side walls 628 and 630 extending therefrom toward either side edge of flap 624. A transverse score line 632 having opposed coincident slits 634 and 636 defines tuck-in flap 638 which is foldable on score line 632.

A first bottom closure flap 640 extends from the lower end of side wall 598 and is foldable about score lines 620 and 580. A second bottom closure flap 642 extends from the lower end of front wall 600 and is foldable about score lines 620, 580 and 582. A third bottom closure flap 644 extends from the lower end of side wall 602 and is foldable about score lines 620, 582 and 584. A fourth bottom closure flap 646 extends from the lower end of side wall 604 and is foldable about score lines 620, 584 and 586. A bottom extension flap 648 extends from the lower end of connecting wall 606 and is foldable about score lines 620 and 586. Bottom flaps 640, 642, 644 and 646 and bottom extension 648 are connected and form an endless series of flaps having lower outer edge 650.

Closure flap 640 includes angularly disposed score lines 652 and 654 which extend from the intersection of score line 620 with side wall 598 outer edge 656 and score line 580. Score lines 652 and 654 preferably include slits 658 and 660, respectively, to assist in folding bottom closure flap 640. Score lines 652 and 654 define generally triangular portions 662, 664 and 666. Triangular portion 664 has its outwardly extending apex 667 severed by outer edge 650. Outer edge 650 increases in distance from score line 620 as edge 650 extends from outer edge 656 to score line 580. Generally triangular portion 664 is an isosceles triangle with a base **664*a* and equal length sides 664*b* and 664*c* extending therefrom. Triangular portion 662 has sides 664*c*, 662*a* and 662*b*. Triangular portion 666 has sides 664*b*, 666*a* and 666*b*. Sides 662*a* and 666*a* are maintained in a spaced parallel relationship and side 66*a* has a length exceeding the length of side 662*a***.

Outer edge 650 is maintained in a spaced parallel relationship relative to score line 620 for the length of flap 642.

Closure flap 644 includes angularly disposed score lines 668 and 670 which extend outwardly from the innersection of score line 620 with score lines 582 and 584, respectively. Preferably, score lines 668 and 670 include slits 672 and 674, respectively, to assist in folding of bottom closure 644. Score lines 668 and 670 define generally triangular portions 676, 678 and 680. Generally triangular portion 678 has its outwardly extending apex 679 severed by outer edge 650. Outer edge 650 of flap 644 decreases in height from score line 582 to score line 584. Generally triangular portion 678 is an isosceles triangle with a base **678*a* and sides 678*b* and 678*c* extending therefrom. Triangular portion 676 has sides 678*b*, 676*a* and 676*b*. Triangular portion 680 has sides 678*c*, 680*a* and 680*b*. Sides 676*a* and 680*a* are disposed in a spaced parallel relationship and side 676*a* has a length exceeding that of side 680*a*. Sides 676*a* and 680*a* are parallel to sides 662*a* and 666*a* and side 676*a* has a length substantially equal to side 666*a* and side 680*a* has a length corresponding to side 662*a***.

Outer edge 650 along the length of closure flap 646 and bottom extension 648 is maintained in a spaced parallel relationship relative to score line 620. Outer edge 650 along the length of flap 642 extends a greater distance for score line 620 than does edge 650 along the length of flap 686. Bottom extension 648 includes angularly disposed score line 682 extending from the intersection of score line 620 and 586 and extending angularly to outer edge 684. Score line 682 preferably includes slit 686 which cooperates with and is connected to slit 688 of score line 620.

Panel 608 includes a platform extension 690 extending from the lower end thereof and foldable about transverse score line 692. Score line 692, preferably includes a series of serrations 694. Panel extension 690 includes transverse score line 696 which, preferably, includes a series of serrations 698. Tuck-in flap 700 extends from platform extension 690 and is foldable about score line 696. Tuck-in flap 700 has outer edge 702 with rounded off edges 704 and 706 extending therefrom.

Dividing wall 610 is foldable on score lines 590 and 592. Preferably, score lines 590 and 592 each include a series of serrations 708 and 710, respectively. The lower outer edge 712 of dividing wall 610 includes a generally circular edge 714 extending from score line 590 and an angled edge 716 extending from edge 714 to score line 592. Preferably, the intersection of edges 714 and 716 creates a notch 718, for reasons to be explained later.

A generally half moon shaped aperture 720 is included in dividing wall 610, spacer 612 and panel 614. Aperture 720 has a lower edge 722 coincident with transverse score line 724 of panel 614.

Panel 614 is foldable on score line 594. Preferably, score line 594 includes a series of serrations 726. Glue flap 616 is foldable on score line 596 and score line 596, preferably, includes a series of serrations 728. Platform extension 730 extends from the lower end of panel 614 and is foldable about score line 724 and score line 724, preferably, includes a series of serrations 732. The outer edge 734 of tuck-in flap 736 extending from platform extension 730 is foldable about transverse score line 738. Outer edge 734, preferably, includes rounded off edges 740 and 742 extending therefrom. Preferably, score line 738 includes a series of serrations 744.

Upper closure flap 746 extends from the upper end of panel 614 and is foldable about score line 748 which, preferably, includes a series of serrations 750. Tuck-in flap 752 is foldable about transverse score line 754. Transverse score line 754, preferably, includes a series of serrations 756. The outer edge 758 of tuck-in flap 752 includes rounded off corners 760 and 762 extending therefrom.

Walls 598, 600 and 602 include transversly extending aperture 764 which has upper and lower spaced parallel edges 766 and 768, respectively. Aperture 764 includes generally rounded edges 770 and 772 disposed between upper and lower surfaces 766 and 768. Aperture 764 is, preferably, closed by removable closure 769 which connects upper edge 766 to lower edge 768 and which may be integral therewith and removable by means of a series of cooperating serrations.

Preferably, top closure flap 620 and 622 include notches 774 and 776, respectively.

FABRICATION OF DOUBLE DISPLAY CARTON C2

Side wall 598 is folded along score line 580 until substantially perpendicular to front wall 600. Side wall 602 is folded along score line 582 until substantially perpendicular to front wall 600. Rear wall 604 is folded along score line 584 until substantially perpendicular to side wall 602 and substantially parallel to front wall 600. Connecting wall 606 is folded along score line 586 until substantially perpendicular to rear wall 604 and substantially parallel to the inner surface of side wall 598 and score line 586 is aligned with outer edge 656. Connecting wall 606 is secured, by glue or other suitable fastening means, to the inner surface of side wall 598. Panel 608 is folded along score line 588 until substantially perpendicular to connecting wall 606 and side wall 598 and substantially parallel to front and rear walls 600 and 604, respectively. Dividing wall 610 is folded along score line 590 until substantially perpendicular to panel 608 and substantially parallel to side wall 598. Spacer or glue flap 612 is folded perpendicularly to dividing wall 610 and substantially parallel to and adjacent to front wall 600. Spacer or glue flap 612 is secured, by glue or other fastening means, to front wall 600. Panel 614 is folded about score line 594 until substantially perpendicular to glue flap 612 and front wall 600. Glue flap 616 is folded along score line 596 until substantially perpendicular to panel 614 and parallel to and adjacent with rear wall 604. Glue flap 616 is secured, by glue or other fastening means, to the inner surface of rear wall 604. Carton C2 is best shown in FIG. 18 prior to sealing of the upper end thereof.

It should be noted, that panel 614 spans the interior of carton C2 and creates a compartment, cannister or chamber 771, as best shown in FIG. 10, which has a depth greater than that of chamber, cannister or compartment 773, as best shown in FIG. 10, because dividing wall 610, as best shown in FIG. 18, does not span the entire depth of the interior of carton C2. Consequently, compartment 771 will accept a larger insert than will compartment 773.

Platform extension 730 is folded along score line 724 until substantially perpendicular to panel 614. Tuck-in flap 736 is folded along score line 738 until substantially perpendicular to platform extension 730 and adjacent to and parallel with the lower end of front wall 600 and outer edge 734 is aligned with score line 620. Platform extension 690 is folded along score line 692 until substantially perpendicular to panel 688 and substantially parallel to platform extension 730. Tuck-in flap or platform support 700 is folded along score line 696 until substantially perpendicular to platform 690 and adjacent with the parallel to side wall 604. Bottom edge 702 is aligned with score line 620. In this way, compartments 771 and 773 are closed at the bottom.

Figure 13:
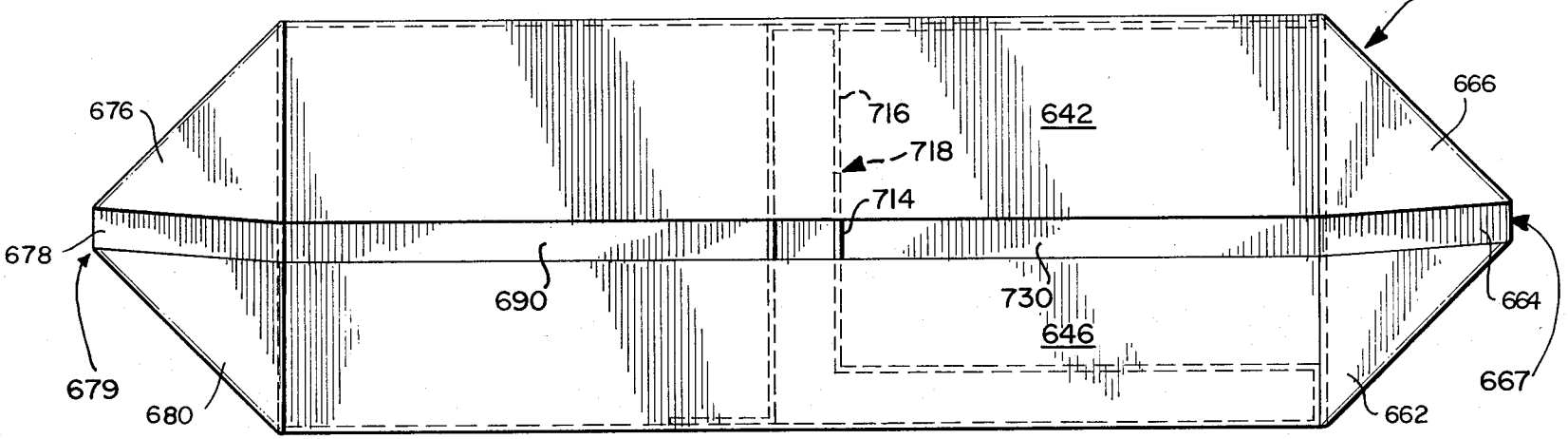
FIG. 13 is a bottom plan view of the bottom closure of FIG. 12 disclosing the bottom closure in the partially closed position.
Figure 14:
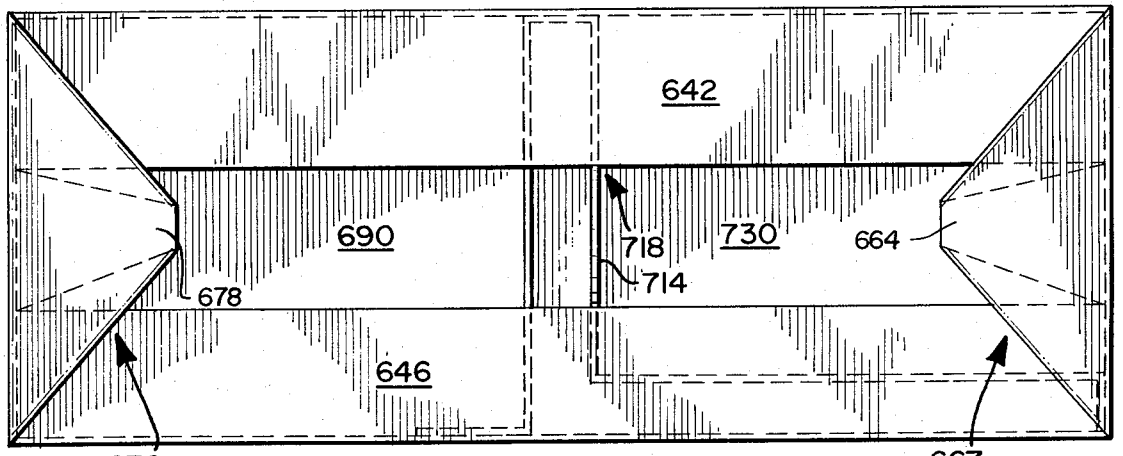
FIG. 14 is a bottom plan view of the bottom closure of FIGS. 12 and 13 in the closed position.
Figure 12:
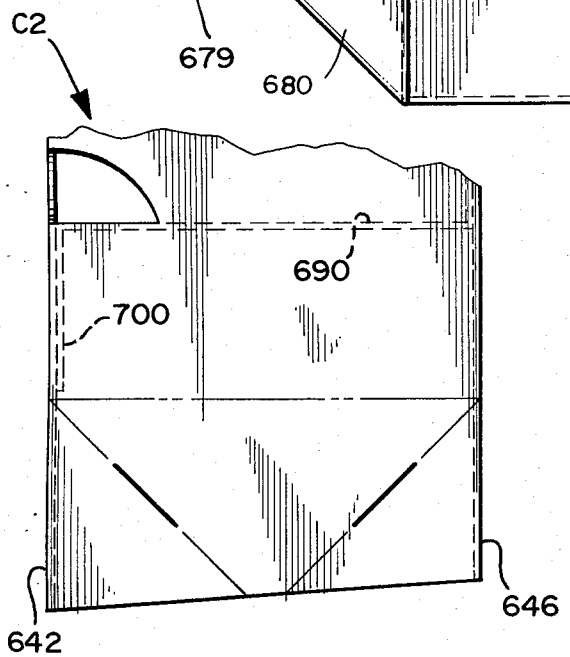
FIG. 12 is a fragmentary side elevational view of the bottom closure of the carton of FIG. 9.
Figure 20:
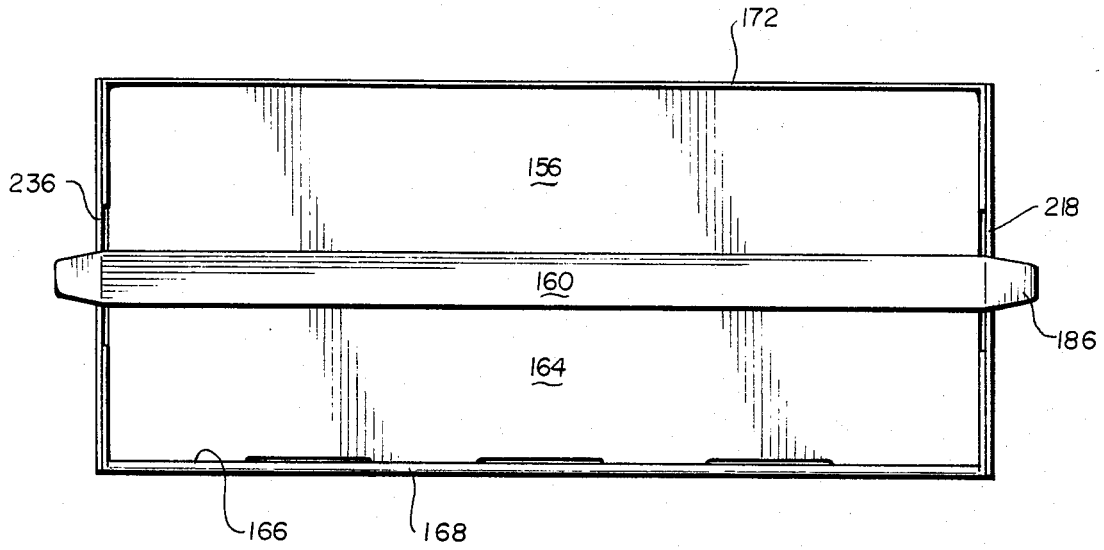
FIG. 20 is a top plan view of the insert of FIG. 19.

The method of closing carton C2 is best shown in FIGS. 12 through 14. Bottom closures 642 and 646 are folded toward each other and inwardly until substantially perpendicular to their respective walls, 600 and 604. Flap 642 extends past the midpoint of carton C2 when perpendicular to wall 600. The folding of flaps 642 and 646 causes generally triangular portions 664 and 678 to be disposed angularly away from their respective walls, 598 and 602, as best shown in FIG. 13. Generally triangular portions 664 and 678 are folded toward each other and inwardly toward the interior of carton C2. The inward folding of generally triangular portions 664 and 678 causes closures 642 and 646 to be angularly disposed below the plane of the bottom of carton C2 as defined by score line 620, as best shown in FIGS. 10 and 11. Generally triangular portions 664 and 678 continue to be displaced inwardly into the interior of carton C2 until they also are angularly disposed relative to their respective side walls, 598 and 602, and until closure 642 locks into lock snap-lock engagment with notch 718. At this point, the combination of the engagement of notch 718 and the integral lengths of flaps 642 and 646 causes the bottom of carton C2 to be securely sealed without the necessity of glue or other fastening means.

Compartments 771 and 773 are now ready for positioning of their respective inserts, I1 and I. Inserts I1 and I have been previously described. Insert I1 is positioned in compartment 771 so that the product (not shown) faces outwardly toward front wall 600. Tab 548 of insert I1 is folded against upper closure 484 and platform extension 730. Tab 552 is folded along score line 478 until parallel to and adjacent closure 506. Upper closure 746 is folded along score line 748 until substantially perpendicular to panel 614 and tuck-in flap 752 is folded along score line 754 until substantially perpendicular to upper closure flap 746 and parallel to side wall 604. Upper closure 746 securely positions insert I1 in compartment 770 therefore.

Insert I is positioned in compartment 773 such that upper closure 218 rests on platform extension 690. Tabs 186 and 188 of insert I are folded back against their respective closure panels, 218 and 236.

Top closure flaps 620 and 622 are folded along score line 618 until substantially perpendicular their respective side walls, 598 and 602. Tuck-in flap 638 is folded along score line 632 until substantially perpendicular to top closure flap 624. Top closure flap 624 is folded along score line 618 until substantially perpendicular to rear wall 604. Outer edge 626 of tuck-in flap 638 is inserted into the gap defined by notches 774 and 776 of top closures 620 and 622, respectively. Top closure 624 continues to be inserted until score line 632 is adjacent to the upper edge 774 of rear wall 604.

In this way, a double display carton adapted for displaying and dispensing at least two different sized substantially rectilinear articles has been disclosed. The double display carton C2 is uniquely adapted for simultaneously dispensing and displaying cigarette packs of both the 100 millimeter and king size length.

While this invention has been described as having a preferred design, it is understood that it is capable of further modifications, uses and/or adaptations of the invention following in general the principals of the invention and including such departures from the present disclosure as come within known or customary practice in the art to which the invention pertains, and as may be applied to the central features hereinbefore set forth, and fall within the scope of the invention of the limits of the appended claims.

What is claimed is:

1. A carton having a closure for one end thereof, comprising:

(a) a first pair of opposed flaps extending from two walls of a carton having four walls and having a plurality of edges;

(b) said first pair of said flaps being substantially rectangular in shape;

(c) one flap of said first pair of said flaps having a width exceeding the width of the other one of said first pair of said flaps;

(d) said first pair of said flaps being folded inwardly and below the plane of said carton bottom and being disposed at an angle to said flaps respective walls;

(e) a second pair of opposed flaps extending from the other two of said walls and having a plurality of edges;

(f) said second pair of said flaps being connected at said edges to said first pair of said flaps to form an endless series of flaps and with each flap of said first and second pair of flaps having a marginal edge;

(g) each of said second pair of said flaps including three generally triangular interconnected portions;

(h) a central one of said triangular portions of said second pair of said flaps having a apex associated with the marginal edge of the associated flap;

(i) each flap of said second cooperating pair of flaps having its marginal edge gradually increasing in width from one of said flaps of said first cooperating pair of flaps to the opposite flap of said first cooperating pair of flaps; and, (j) said generally triangular portions of each of said second pair of said flaps being folded inwardly and disposed at an angle to the associated walls whereby said first pair of said flaps and said second pair of said flaps snap into locking engagement and retain said first pair of said flaps and second pair of said flaps below the plane of said carton bottom.

2. A carton having a closure for one end thereof, comprising:

(a) first pair of opposed flaps extending from two walls of a carton having four walls, each flap of said first pair of flaps including three generally triangular portions and said triangular portions of one of said first pair of flaps opposed from the generally triangular portions of the other of said first pair of flaps;

(b) a second pair of opposed flaps extending from the other two of said walls, said second pair of flaps being substantially rectangular in shape and one of said second pair of flaps having a width exceeding said width of the other flap of said second pair of flaps;

(c) each of said first and second pair of flaps being interconnected and thereby forming a continuous series of flaps and with each of said flaps having a marginal edge;

(d) each of said first pair of flaps having its marginal edge gradually increasing in width from one of said flaps of said second pair of flaps to the opposite flap of said second pair of flaps; and, (e) said second pair of flaps adapted for being folded inwardly and below the plane of said carton bottom prior to folding of said first pair of flaps whereby said first pair and said second pair of flaps snap inwardly and remain below said carton bottom.

3. A carton having a closure for one end thereof, comprising:

(a) said carton having four walls and with each of said four walls having a flap extension, each of said extensions having edges on either side thereof;

(b) each of said flap extensions being interconnected at its edges with adjacent flap extensions to form an endless series of flaps;

(c) said flaps forming first and second cooperating pairs of opposed flaps and each flap of said pairs having marginal edges;

(d) each flap of said first cooperating pair of flaps having a series of fold lines substantially forming three generally triangular sections, said three triangular sections including a generally shaped central isosceles triangle bounded on one side by a first triangle and on the other side by a second triangle and said first triangle being smaller than said second triangle;

(e) said second of said cooperating pairs of flaps having one flap of a width greater than the width of the opposite flap of said second cooperating pairs of flaps and said first triangle of each of said first cooperating pairs of flaps being adjacent the opposite flap of said second cooperating pair of flaps;

(f) each flap of said first cooperating pair of flaps having its marginal edges gradually increasing in width from one of said flaps of said second cooperating pair of flaps to the opposite flap of said second cooperating pair of flaps;

(g) said three generally triangular sections of each of said first cooperating pair of flaps being contiguous;

(h) said three generally triangular sections of each of said first cooperating pair of flaps meeting at an apex associated with said marginal edges of each of said first cooperating pair of flaps; and, (i) whereby, when said second cooperating pair of flaps is folded inwardly prior to the folding of said first cooperating pair of flaps, said end closure will snap inwardly and remain below the plane of the bottom of said carton.

4. A carton as in claim 3, wherein:

a. said generally triangular sections being defined by a plurality of score lines.

5. A carton as in claim 4, wherein:

a. said plurality of score lines including slits having a length less than said score lines length.

6. A carton as in claim 3, further comprising:

a. an aperture in one of said walls.

7. A carton as in claim 6, further comprising:

a. a panel opposed from said aperture and adjacent with and substantially parallel to one of said walls;

b. a platform extending from said panel and connected to said wall having said aperture;

c. said aperture having an upper edge and a lower edge;

d. said platform having an upper surface adjacent said aperture lower edge; and, e. a hinged support extending from said platform adjacent with and substantially parallel to said wall having said aperture whereby said support contacts said closure to positively support said platform.

8. A carton as in claim 7, further comprising:

a. a removable cover closing said aperture.

9. A carton as in claim 7, further comprising:

a. a top closure for said carton other end.

10. A carton as in claim 9, further comprising:

a. an insert positioned in said carton and having an end member engaging said platform upper surface;

b. a receptacle in said insert for holding a plurality of articles and, c. said receptacle cooperating with said aperture for permitting withdrawal of said articles through said aperture.

11. A carton as in claim 10, further comprising:

a. a plurality of receptacles in said insert adapted for holding a plurality of articles and cooperating with said aperture for permitting withdrawal of one of said articles through said aperture; and, b. each of said receptacles being isolated from adjacent receptacles by a body member.

12. A carton as in claim 11, wherein:

a. said insert comprising:

i. a flat base member;

ii. a plurality of wall members extending perpendicularly from said base member periphery; and, iii. a centrally positioned body member extending perpendicularly from said base member and parallel to said wall members whereby said body member defines a plurality of receptacles.

13. A carton as in claim 12, further comprising:

a. a second base member adjacent to and parallel to said flat base member;

b. two longitudinal wall members disposed in spaced parallel relationship extending perpendicularly from said second base member and parallel to said wall members;

c. a support member parallel to said base member connecting said two longitudinal wall members at their end opposite said base member;

d. said two longitudinal wall members containing a plurality of apertures; and, e. a plurality of interdigitated fingers extending from each of said wall members for cooperating with said apertures to maintain said longitudinal wall members in said spaced parallel relationship.

14. A carton as in claim 13, further comprising:

a. an aperture in said platform;

b. an aperture in said top closure; and, c. opposed first and second extensions extending from said support member whereby said first support extension engages said top closure aperture and said second support extension engages said platform aperture whereby said insert is maintained in locking engagement with said closure and said top closure.

15. A carton as in claim 10, further comprising:

a. said carton having a length exceeding said carton width;

b. a front wall and a back wall of said carton being associated with said length;

c. side walls having edges disposed between said front wall and said back wall being associated with said width;

d. said aperture substantially spanning said front wall; and, e. a substantially L-shaped member connected to one of said side walls and said front wall for dividing said carton interior into two chambers.

16. A carton as in claim 15, wherein:

a. said L-shaped member having a width substantially equal to said carton width;

b. said L-shaped member connected to said side wall intermediate said side wall edges for dividing said carton interior into two chambers, one of said chambers being larger than the other of said chambers.

17. A carton as in claim 16, further comprising:

a. a wall spacer member disposed between said front wall and said rear wall and parallel to said side walls for dividing said carton into chambers and said chambers having equal length and unequal width; and, b. a flap extension extending from said wall spacer member and perpendicular thereto for closing said chamber having said greater width and including an extension thereto for cooperating with said top closure for securing said flap extension.

18. A carton as in claim 17, further comprising:

a. a first insert positioned in said chamber having said lesser width and including a body member for defining a pair of article receptacles, said body member having a width substantially equal to said lesser width of said chamber; and, b. a second insert positioned in said chamber having said greater width and including a body member for defining a pair of product receptacles, said body member having a width substantially equal to said greater width of said chamber.

19. A carton as in claim 15, wherein:

a. said L-shaped member includes a notch for cooperating with said first cooperating pair of flaps for securing said closure.

20. A blank for a carton comprising:

(a) a flat member having first, second, third, fourth and fifth spaced parallel longitudinal score lines thereon defining a glue flap, a first side wall, a front wall, a second side wall, a rear wall and a panel;

(b) a first transverse score line thereon defining a lower end for said walls;

(c) second transverse score line thereon defining an upper end for said first and said second side wall and said front wall;

(d) an aperture in said front wall spaced from said first transverse score line;

(e) a top closure flap extending from the upper end of said first wall, the outwardly extending edge of said flap having a transverse score line defining a tuck-in flap, said top closure flap having a width substantially equal to said side walls length;

(f) a first auxiliary top closure flap extending from said first side wall upper end and a second auxiliary top closure flap extending from said second side wall upper end, said first and said second auxiliary top closure flaps having a width substantially less than said front wall length and having a length substantially less than said top closure flap width and adapted for cooperating with said top closure flap for sealing the upper end of said carton;

(g) said panel having a depth substantially less than said walls depth and having a transverse score line thereon aligned with said aperture lower edge and defining a platform extension associated with said panel lower end and said panel having a length substantially equal to said rear wall length;

(h) said platform extension extending from said panel lower end and having a depth substantially equal to said side wall length to substantially span said carton interior from said rear wall to said side wall and having a transverse score line on the outer outward edge for defining a support member for positively positioning said platform adjacent said aperture lower edge;

(i) an interconnected series of wall extensions extending from said walls lower end defining said carton bottom closure and including longitudinal score line extensions coincident with said second, said third and said fourth score lines;

(j) said first side wall lower end extension having a first longitudinal score line extension coincident with said first score line for defining a second glue flap;

(k) said first side wall lower end extension having a depth increasing from said second glue flap to said front wall lower end extension;

(l) said second side wall lower end extension having a depth increasing from said rear wall lower end extension to said front wall lower end extension;

(m) said front wall lower end extension having a depth exceeding said rear wall lower end extension depth; and, (n) said first and second side walls lower end extension each having a pair of cooperating score lines defining three generally triangular portions with a apex associated with the outward edge of said extensions whereby, after said carton has been formed, said first and second side walls lower end extensions each have the marginal edge thereof gradually increasing in depth and are adapted for being folded inwardly and below said lower end and said generally triangular portions snap into locking engagement whereby said closures secures said carton end.

21. A blank as in claim 20, wherein:

a. said aperture extends transversely of said front wall and includes extensions thereof in said first and said second side walls.

22. A blank as in claim 20, further comprising:

a. said first, said second, said third, and said fourth longitudinal score line extensions including a slit therethrough, said slit having a length substantially less than said score line extension length;

b. said first and said second side walls lower end extensions cooperating score lines including slits therethrough extending a distance less than said cooperating score lines distance;

c. said panel transverse score line having at least one slit therethrough and said at least one slit having a length substantially less than said panel transverse score line; and, d. said top closure transverse score line including at least one slit therethrough and said at least one slit having a length substantially less than said top closure transverse score line length.

23. A blank for an insert, comprising:

(a) a flat member having first, second, third, fourth, fifth, sixth, seventh and eighth spaced parallel longitudinal score lines thereon defining a first wall member, a flat base, a second wall member, a third wall member, a first base member, a first wall support member, a connecting member, a second wall support member, and a second base member;

(b) said first wall support member having a plurality of first sized U-shaped slits defining a plurality of first sized flat fingers associated with said first wall support member;

(c) said second wall support member having a plurality of second sized U-shaped slits defining a plurality of second sized fingers associated with said second wall support member and said second sized fingers having a length exceeding said first sized fingers length for permitting interdigitation of said first and second fingers whereby said second sized fingers are prevented from passing through said first sized U-shaped slits to thereby maintain said first and second wall support members parallel when the insert is assembled;

(d) said first and said second wall members and said flat base having a transverse score line thereon defining an upper end thereof;

(e) said first and said second wall members and said flat base having a second transverse score line parallel to and spaced from said transverse score line for defining a lower end thereof;

(f) said first wall member having a first rectangular end wall extending from the upper end thereof and a second rectangular end wall extending from the lower end thereof;

(g) said flat base having an upper end wall extending from the upper end thereof and a lower end wall extending from the lower end thereof;

(h) said flat base upper end wall and said lower end wall each having a pair of angularly disposed score lines thereon; and, (i) said second wall member having a first rectangular end wall extending from the upper end thereof and a second rectangular end wall extending on the lower end thereof.

24. A blank as in claim 23, further comprising:

a. upper and lower tab extensions associated with said connecting member.

* * * * *